US006377436B1

(12) United States Patent
Margolin

(10) Patent No.: US 6,377,436 B1
(45) Date of Patent: Apr. 23, 2002

(54) MICROWAVE TRANSMISSION USING A LASER-GENERATED PLASMA BEAM WAVEGUIDE

(76) Inventor: Jed Margolin, 3570 Pleasant Echo Dr., San Jose, CA (US) 95148-1916

( * ) Notice: Subject to any disclaimer, the term of this patent is extended or adjusted under 35 U.S.C. 154(b) by 0 days.

(21) Appl. No.: 09/543,252

(22) Filed: Apr. 5, 2000

Related U.S. Application Data

(60) Provisional application No. 60/173,148, filed on Dec. 27, 1999.

(51) Int. Cl.[7] ..... H01T 23/00
(52) U.S. Cl. ..... 361/230; 307/149
(58) Field of Search ..... 361/230, 231; 307/149; 372/1, 4, 9, 14, 15, 29.01, 109, 76; 250/396 R, 423 R, 424; 385/147; 342/54; 359/27, 34, 179, 188, 298, 299, 342, 349

(56) References Cited

U.S. PATENT DOCUMENTS

| | | | | |
|---|---|---|---|---|
| 3,719,829 A | * | 3/1973 | Vaill | 307/149 |
| 5,726,855 A | | 3/1998 | Mourou et al. | 361/213 |
| 5,930,313 A | * | 7/1999 | Slinker et al. | 376/127 |
| 6,111,237 A | * | 8/2000 | Paustian | 361/117 |

OTHER PUBLICATIONS

News Release: Los Alamos National Labortary, Aug. 19, 1996, "There's new light at the end of the tunnel for some laser–based technologies." http://www/.lanl.gov.
Product Announcement: Lawrence Livermore National Laboratory, "High–Average–Power Titanium:Sapphire Laser", http://www.Illnl.gov/IPandC/op96/05/5f–hig.html, No Date.
Company Information: Hardric Laboratories, Inc., http://www.hardic.com, No Month 1999.
Product/Services Announcement: Hardric Laboratories, Inc. "Beryllium Optics", http://www.hardric.com/page 4.html, No Date.

* cited by examiner

*Primary Examiner*—Ronald W. Leja

(57) ABSTRACT

A directed energy beam system uses an ultra-fast laser system, such as one using a titanium-sapphire infrared laser to produce a thin ionizing beam through the atmosphere. The beam is moved in either a circular or rectangular fashion to produce a conductive shell to act as a waveguide for microwave energy. Because the waveguide is produced by a plasma it is called a plasma beam waveguide. The directed energy beam system can be used as a weapon, to provide power to an unmanned aerial vehicle (UAV) such as for providing communications in a cellular telephone system, or as an ultra-precise radar system.

11 Claims, 23 Drawing Sheets

Laser Assembly 10

(Front View)

Laser Assembly 10

(Bottom View)

Laser Assembly 40

(Front View)

Laser Assembly 70

Mirror Assembly 203

MICROWAVE TRANSMISSION USING A LASER-GENERATED PLASMA BEAM WAVEGUIDE

CROSS REFERENCES TO RELATED APPLICATIONS

This application claims the benefit of U.S. Provisional Application No. 60/173,148 filed on Dec. 27, 1999.

BACKGROUND OF THE INVENTION

Field of Invention

This invention relates to a directed energy beam system.

BACKGROUND OF THE INVENTION

Prior Art

From a 1996 press release from Los Alamos National Laboratory titled, "There's new light at the end of the tunnel for some laser-based technologies":

"Researchers Xin Miao Zhao, David Funk, Charlie Strauss, Toni Taylor and Jason Jones experimenting with a powerful infrared titanium-sapphire laser found that when a light pulse intensity reaches a critical value, the beam focuses itself into a thin filament without the aid of focusing lenses or mirrors and perpetuates itself for long distances.

The beam—two to three times the thickness of a human hair—propagates virtually indefinitely through air without spreading, something conventional lasers cannot do."

U.S. Pat. No. 5,726,855 APPARATUS AND METHOD FOR ENABLING THE CREATION OF MULTIPLE EXTENDED CONDUCTION PATHS IN THE ATMOSPHERE, issued Mar. 10, 1998 to Mourou et al. teaches a method for enabling the creation of multiple extended conduction paths in the atmosphere through the use of a chirped-pulse amplification laser system having a high peak-power laser capable of transmitting through the atmosphere a high-peak power ultrashort laser pulse.

The creation of the conduction path is described in Column 4, line 50 through Column 5, line 22:

"For a high peak-power ultrashort pulse, the peak-power can be strong enough to drive the electrons of the material it is propagating through their linear regime and into a nonlinear regime. In this case, the index of refraction for the material can be written n(r)=n.sub.0+n.sub.2 I(r), where n(r) is the radially varying index of refraction, n.sub.o is the linear (standard) index of refraction, n.sub.2 is the nonlinear refractive index, and I(r) is the radially varying intensity. Since the center of the beam has a higher intensity than the outer edges, the index of refraction varies radially (just as in a regular glass lens), and the pulse experiences a positive lensing effect, even if it is collimated at low powers. This is called self-focusing. The critical peak-power needed to start self-focusing is given by Pcr=.lambda.. sup.2/(2.pi.n.sub.2) which for air is 1.8.times.10.sup.9 W but has been measured to be more like 1.times.10.sup.10 W. With an initially smooth spacial beam, only one filament appears at the center of the beam. Once the beam (or part of it) self-focuses, it will not focus to an arbitrarily small size. It will self-focus until the intensity of the pulse is large enough to ionize the material. This generated plasma reduces the on-axis index of refraction by an amount given by 4.pi.e.sup.2 n.sub.e (I)/(2m.sub.e omega.. sup.2) where n.sub.e (I) is the intensity dependent generated plasma density, e is the electron charge, m.sub.e is the electron mass, and omega. is the laser frequency. Again, the beam experiences a radially varying index of refraction change (because n.sub.e (I) is radially varying) and the change due to the plasma acts as a negative (defocusing) lens. So, through the balance of the continual self-focusing (positive lens) and the plasma defocusing and natural diffraction (negative lens), the pulse stays confined to a high-intensity, small diameter over many meters of propagation while automatically producing free electrons. This is a 'natural' way of generating an extended plasma channel. The only preparation needed from the user is to generate the high peak-power laser pulse.

Each self-focused "hotspot" creates one electrically conductive ionized channel or plasma column in the atmosphere. The plasma columns can be used for many different applications, one such application being to safely and repetitively control the discharge of lightning strikes before natural breakdown occurs to protect power plants, airports, launch sites, etc."

Hardric Laboratories, Inc. of North Chelmsford, Mass., produces mirrors made of bare-polished beryllium metal that produce a high level of reflectivity.

BACKGROUND OF THE INVENTION

The world is a hostile place. In recent years there has been a proliferation of countries with strategic and tactical ballistic missiles and cruise missiles capable of delivering nuclear, biological, and chemical weapons. The methods used to combat these threats fall into two categories: Lasers and Anti-Missile Missiles (AMM).

An example of the first category is the Airborne Laser (ABL) which uses a high-power chemical laser and is carried in a 747 aircraft. Because it uses a chemical laser it can fire only a limited number of times before the chemicals are used up. In addition, its use in a 747 makes it vulnerable to being shot down.

In the category of Anti-Missile Missiles, all systems share the disadvantage that an AMM, however fast, takes time to reach the target. This reduces the time available for finding and identifying it as a threat. It also makes second shots less possible.

Accordingly, one of the objects and advantages of my invention is to provide a new method of providing a defense against ballistic missiles and cruise missiles.

Further objects and advantages of my invention will become apparant from a consideration of the drawings and ensuing description.

SUMMARY OF THE INVENTION

A laser system, such as the one taught by Mourou et al. is used to produce a thin ionizing beam through the atmosphere. The thin ionizing beam, or plasma beam, is electrically conducting and is moved in either a circular or rectangular fashion to produce a conductive shell to act as a waveguide for microwave energy. Since the waveguide is composed of a plasma it is called a plasma beam waveguide.

In a first embodiment the plasma beam waveguide is formed by physically moving the laser system used to produce the beam. Microwave energy is coupled into the plasma beam waveguide through a hole in the laser assembly.

In a second embodiment the laser system is stationary and the beam is moved by using a parabolic mirror with an offset feed. A flat mirror, using a mirror positioner having either one or two degrees of freedom, is mounted at the feedpoint and is used to reflect the laser beam around the periphery of the parabolic mirror, producing a shell. Microwave energy is coupled into the plasma beam waveguide through a hole in the center of the parabolic mirror. This is the reason for using a parabolic mirror with an offset feed.

In a third embodiment the laser system is also stationary and the beam is moved by using a parabolic mirror with an offset feed. However, the beam is electrically accelerated and then magnetically deflected by an orthogonal pair of electromagnetic coils at the feedpoint. The plasma beam is electrically accelerated by inducing a current in the plasma beam between two conducting mirrors. To accomplish this, both mirrors are made of a conducting material such as beryllium metal, and a current source is connected between them.

In all three embodiments the entire assembly can be mounted on a standard azimuth-elevation mount to allow the system to be aimed.

Since microwave energy can be produced more efficiently than laser energy, this system can be used to deliver a directed beam of energy more efficiently than a laser acting alone.

At high power levels the directed energy beam system can be used as a weapon. Because the system operates soley from electricity it is easily scaled by adding more units. Therefore its use as a defense weapon has an advantage over its use as an offensive weapon.

Another use at high power levels is to power the first stage of a rocket booster. A number of directed energy beam systems are arranged to direct their energy beams at a rocket booster whose fuel consists of water. The microwave energy is used to superheat the water which is then directed through a conventional rocket engine nozzle. The use of water as a fuel eliminates the toxicity problems of conventional rocket fuels. Water is also less expensive and more easily stored than conventional rocket fuels.

At moderate power levels the directed energy beam system can be used to provide power to an unmanned aerial vehicle (UAV), enabling the UAV to remain on-station for extended periods of time.

Because an object interrupting a waveguide produces a discontinuity in waveguide impedance which is reflected back to the source this system can also be used to track the UAV to maintain beam position.

Where it is not necessary to transmit appreciable amounts of power, the directed energy beam system can be used as an ultra-precise radar system.

DETAILED DESCRIPTION

In the following description, numerous specific details are set forth to provide a thorough understanding of the invention. However, it is understood that the invention may be practiced without these specific details. In other instances, well-known circuits, structures and techniques have not been shown in detail in order not to obscure the invention.

A laser system is used to produce a thin ionizing beam through the atmosphere. An example of such a laser system using a titanium-sapphire infrared laser is taught in U.S. Pat. No. 5,726,855 APPARATUS AND METHOD FOR ENABLING THE CREATION OF MULTIPLE EXTENDED CONDUCTION PATHS IN THE ATMOSPHERE, issued Mar. 10, 1998 to Mourou et al.

The beam is moved in either a circular or rectangular fashion to produce a conductive shell to act as a waveguide for microwave energy.

For the purposes of this application the terms Focal Point, Feedpoint, and FP will mean the same thing. The terms Plasma Beam Waveguide, Plasma Beam Conduit, and Plasma Beam Shell will also all mean the same thing. In addition, the term Laser System means a chirped-pulse amplification laser system having a high peak-power laser capable of transmitting a high-peak power ultrashort laser pulse through the atmosphere.

Figure 5A:
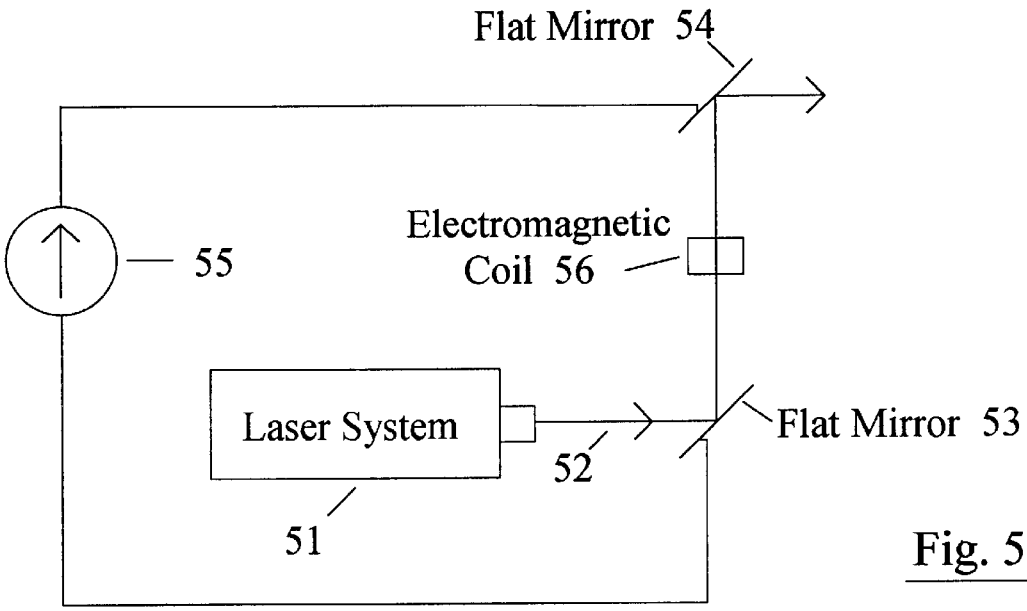
FIG. 5A shows a general method of accelerating a Plasma Beam and affecting its properties with an electromagnetic coil.

A general method of accelerating a plasma beam is shown in FIG. 5A. Laser System 51 produces Plasma Beam 52 which is reflected off Flat Mirror 53 and Flat Mirror 54 which are made of an electrically conducting material such as beryllium metal. Current Source 55 is connected between Flat Mirror 53 and Flat Mirror 54. Current Source 55 may be a direct current, an alternating current, and may also be modulated. Electromagnetic Coil 56 may also be used to modulate Plasma Beam 52.

Figure 5B:
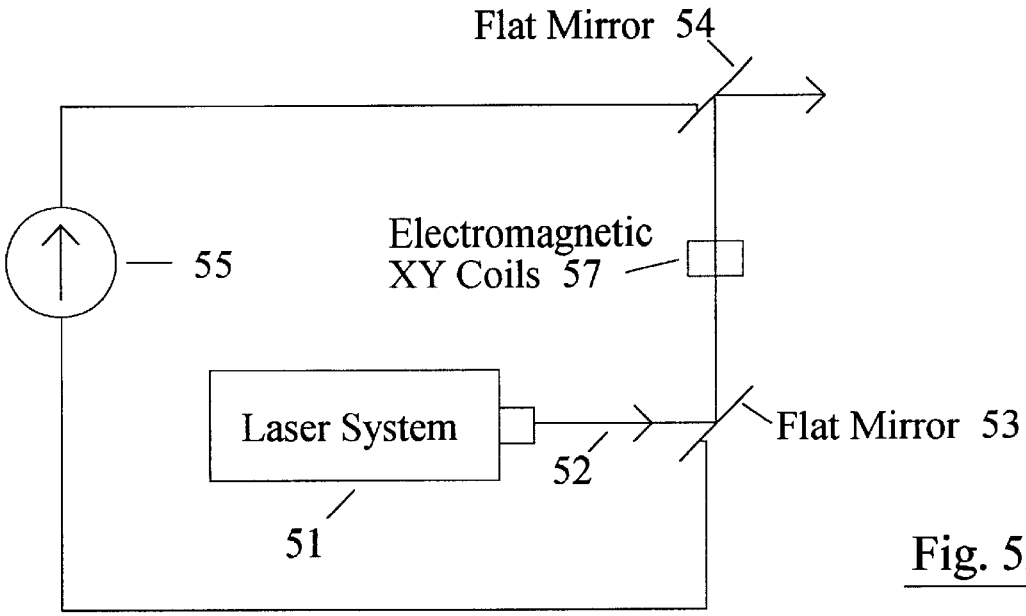
FIG. 5B shows a general method of accelerating a Plasma Beam and affecting its properties with a set of orthogonal electromagnetic coils.

In FIG. 5B the plasma beam between Flat Mirror 53 and Flat Mirror 54 is deflected by a pair of orthogonally mounted electromagnetic coils, designated as Electromagnetic XY Coils 57, much as the electron beam in a cathode ray tube is magnetically deflected by a standard set of deflection coils.

First Embodiment

The following describes a system using two laser systems where the plasma beam conduit is formed using a mechanical system that physically moves the laser systems used to produce the beam. Microwave energy is coupled into the plasma beam conduit through a hole in the laser assembly. The plasma beam conduit has a circular cross-section.

Figure 1A:
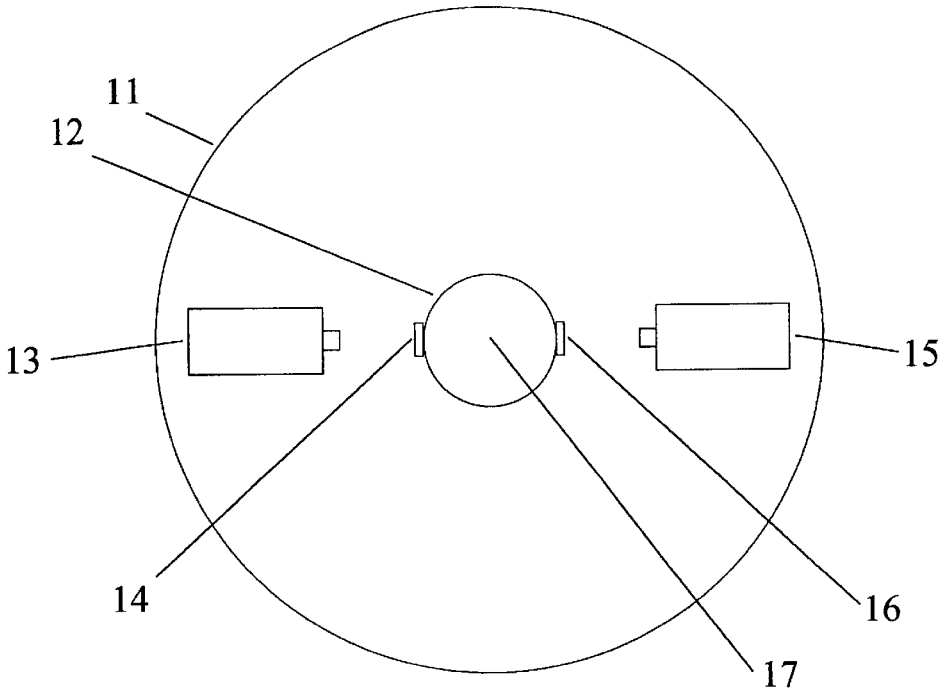
FIG. 1A shows the front view of an assembly with two laser systems mounted on a cylindrical disk with a hole in the center of the cylindrical disk.
Figure 1B:
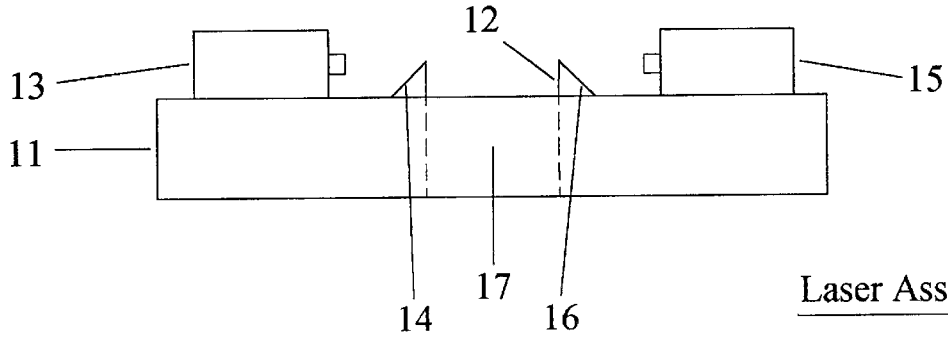
FIG. 1B shows the bottom view of the assembly of FIG. 1A.
Figure 2A:
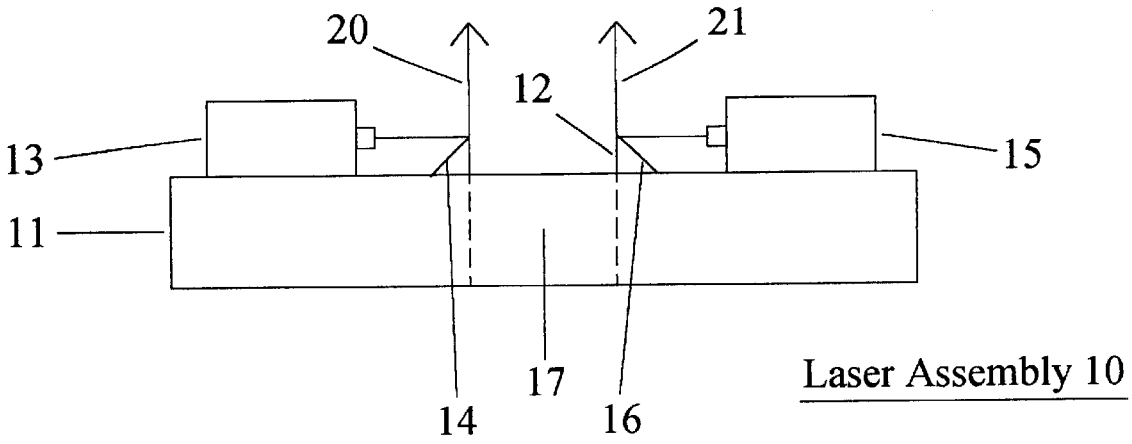
FIG. 2A shows the assembly of FIG. 1B with a plasma beam being generated by each laser system.

In FIG. 1A, Laser Assembly 10 is formed by mounting Laser System 13 and Laser System 15 on Cylindrical Disk 11 which is electrically conductive. Hole 17 is in the center of Cylindrical Disk 11. Mirror 14 deflects the beam from Laser System 13. Similarly, Mirror 16 deflects the beam from Laser System 15. Sleeve 12 is electrically conducting and provides a smooth conducting surface extending from Hole 17. This is shown in FIG. 1B. FIG. 2A shows Beam 21 from Laser System 15 being deflected from Mirror 16 to continue the conducting path from Hole 17 and Sleeve 12. Similarly, Beam 20 from Laser System 13 is deflected from Mirror 14 to continue the conducting path from Hole 17 and Sleeve 12.

Figure 2B:
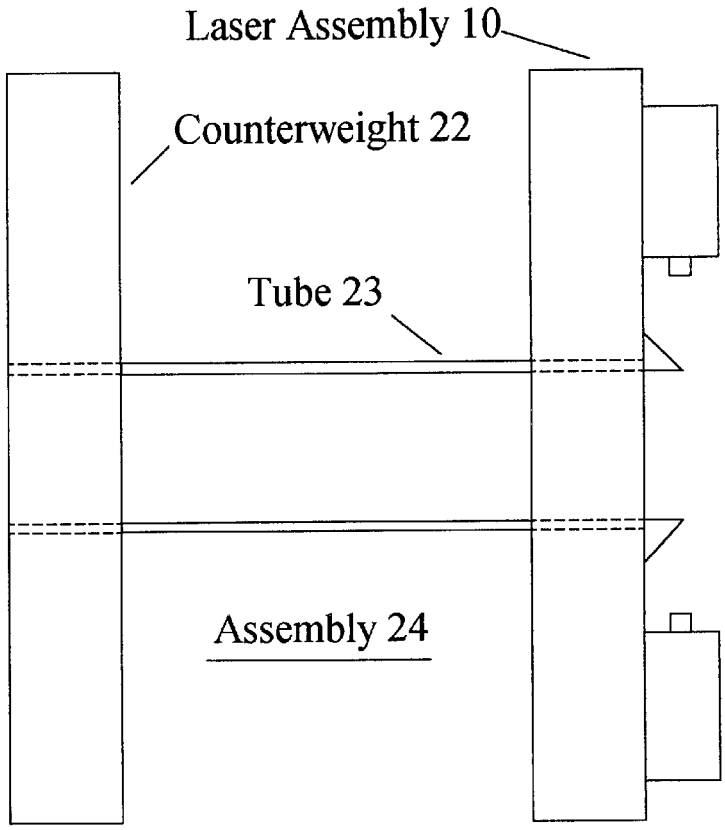
FIG. 2B shows the assembly of FIG. 1A mounted on a cylindrical tube with a counterweight on the opposite end of the cylindrical tube.

In FIG. 2B, Assembly 24 is made by mounting Laser Assembly 10 at one end of Conducting Tube 23. Counterweight 22 is mounted at the opposite end of Conducting Tube 23 to provide dynamic balancing.

Figure 3:
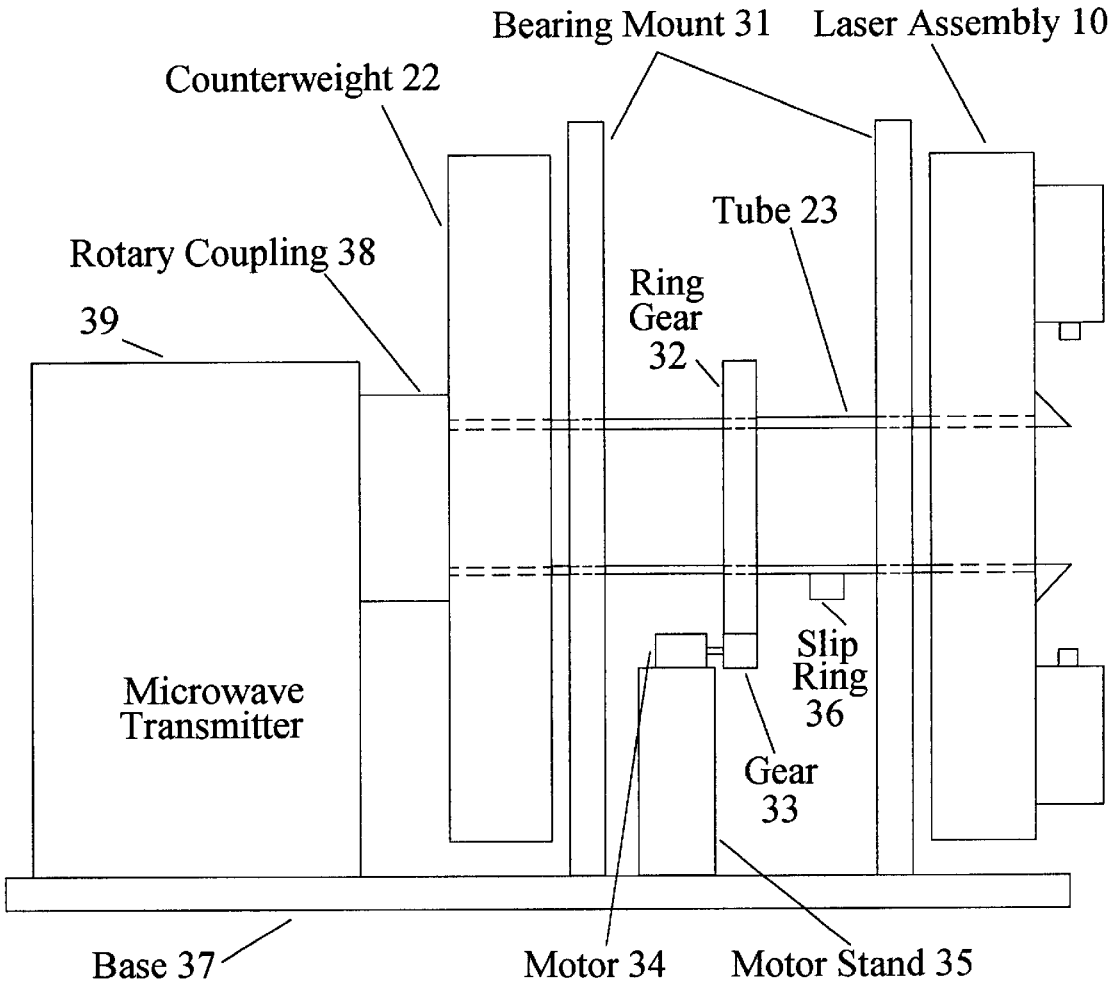
FIG. 3 shows the assembly of FIG. 2B supported by a bearing mount attached to a base, rotated by a motor, and coupled to a microwave transmitter.

In FIG. 3, Assembly 24 (made from Laser Assembly 10, Conducting Tube 23, and Counterweight 22) is mounted on Bearing Mount 31 to allow Assembly 24 to rotate. Ring Gear 32 is mounted around the circumference of Conducting Tube 23 and engages Gear 33 which is turned by Motor 34. Motor 34 is supported by Motor Stand 35. Base 37 supports both Motor Stand 35 and Bearing Mount 31. Microwave Transmitter 39 is also mounted on Base 37 and is coupled to Conducting Tube 23 through Rotary Coupling 38, whose design is well known to those in the field of Radar. Power to Laser Assembly 10 is supplied through Slip Ring Assembly 36. In operation, Laser Assembly 10 rotates, causing the beams from Laser System 13 and Laser System 15 to produce a cylindrical conductive shell to act as a waveguide for the Energy from Microwave Transmitter 39. Mirror 14 and Mirror 16 are precisely aligned so that only a single conductive shell is produced.

Referring to FIG. 1A, the reason for using two laser systems is to dynamically balance Cylindrical Disk 11 and to reduce the speed at which the system must rotate. Alternately, one laser system can be replaced by the appropriate balancing weights. As a further alternative, more than two laser systems may be used as long as they are spaced appropriately in order to preserve the dynamic balance of Laser Assembly 10. Where more than one laser system is used, they are precisely aligned so that only a single conductive shell is produced.

Figure 4:
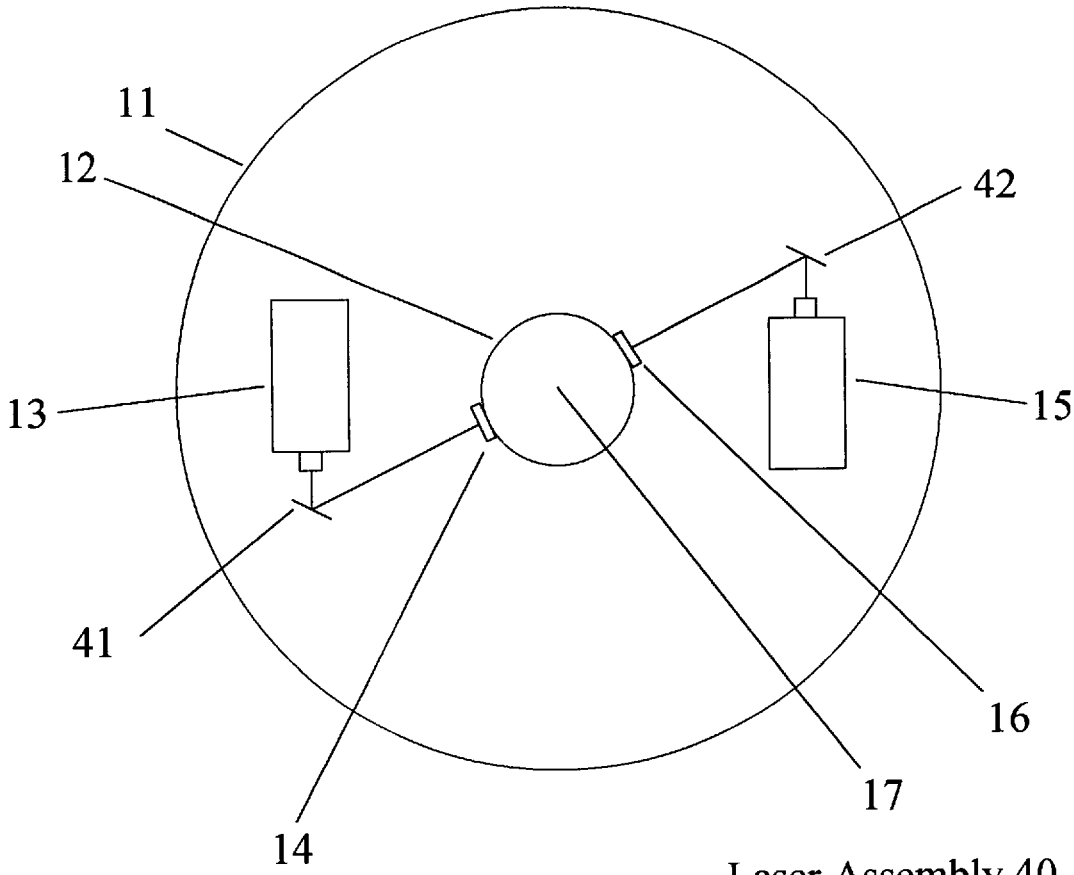
FIG. 4 shows an alternate arrangement of two laser systems mounted on a cylindrical disk with a hole in the center of the cylindrical disk.

An alternative to the arrangement shown for mounting Laser System 13 and Laser System 15 is shown in FIG. 4. In this arrangement, Laser System 13 and Laser System 15 are mounted tangentially on Conducting Disk 11. Mirror 41 directs the beam from Laser System 13 to Mirror 14, while Mirror 42 directs the beam from Laser System 15 to Mirror 16. The assembly thus produced (Laser Assembly 40) is used in place of Laser Assembly 10 in FIG. 3. Again, the reason for using two laser systems is to dynamically balance Cylindrical Disk 11 and to reduce the speed at which the system must rotate. Alternately, one laser system can be replaced by the appropriate balancing weights. As a further alternative, more than two laser systems may be used as long as they are spaced appropriately in order to preserve the dynamic balance of Laser Assembly 40. Where more than one laser system is used, they are precisely aligned so that only a single conductive shell is produced.

One advantage of Laser Assembly 40 is to produce a more compact arrangement of its components. Another advantage is that it makes it easy to use an electric current to accelerate the plasma beams produced by Laser System 13 and Laser System 15 by the method previously described in reference to FIG. 5A and FIG. 5B.

The following describes a different arrangement using two laser systems where the plasma beam conduit is formed using a mechanical system that physically moves the laser systems used to produce the beam. Microwave energy is coupled into the plasma beam conduit through a tube in the laser assembly. The plasma beam conduit has a circular cross-section.

Figure 6A:
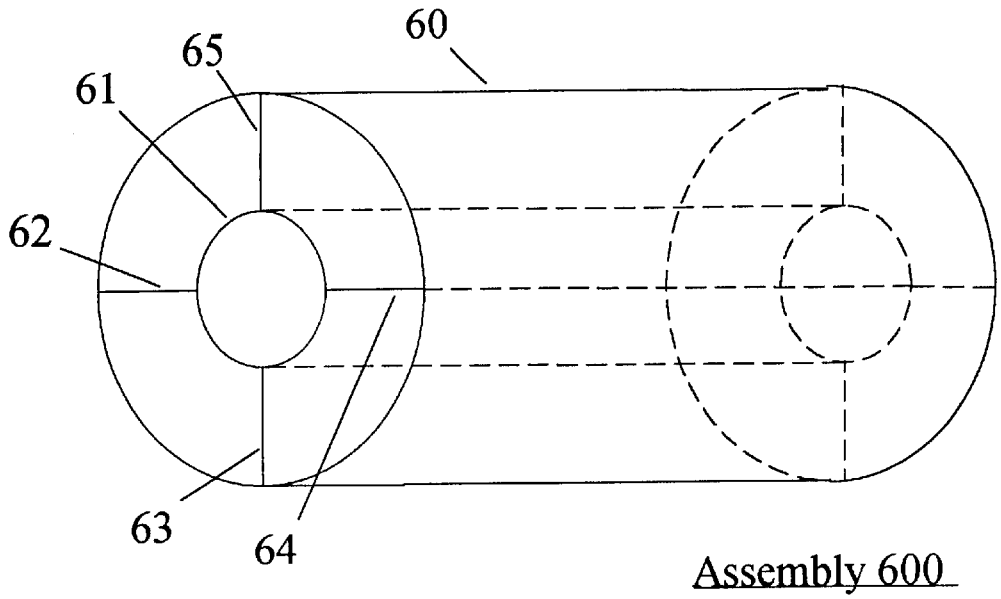
FIG. 6A shows an assembly with an inner cylinder attached to an outer cylinder with four rectangular members to create four cavities.
Figure 6B:
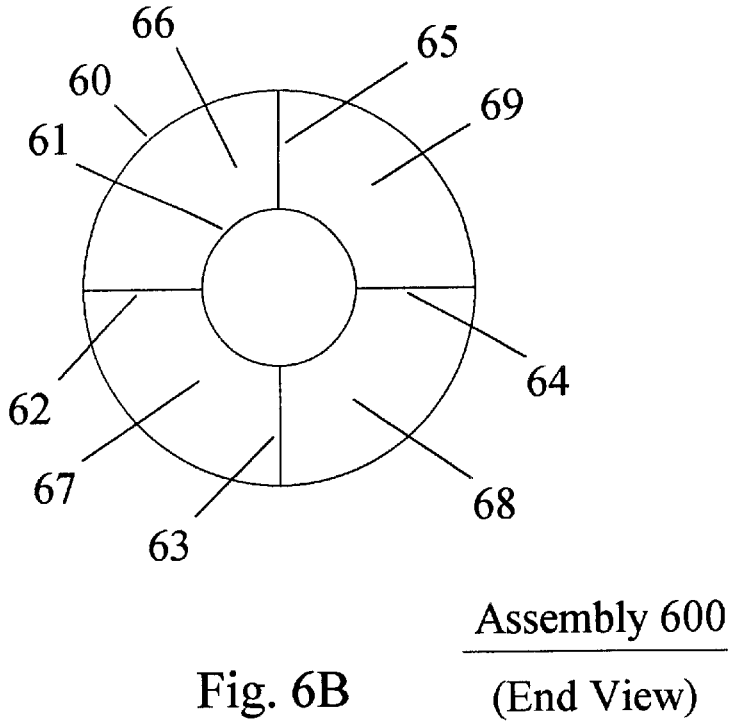
FIG. 6B shows an end view of the assembly of FIG. 6A.

In FIG. 6A, Assembly 600 consists of an electrically conducting Inner Cylinder 61 attached to Outer Cylinder 60 through the use of Rectangular Members 62, 63, 64, and 65. Referring to FIG. 6B, this results in the creation of Cavities 66, 67, 68, and 69.

Figure 7:
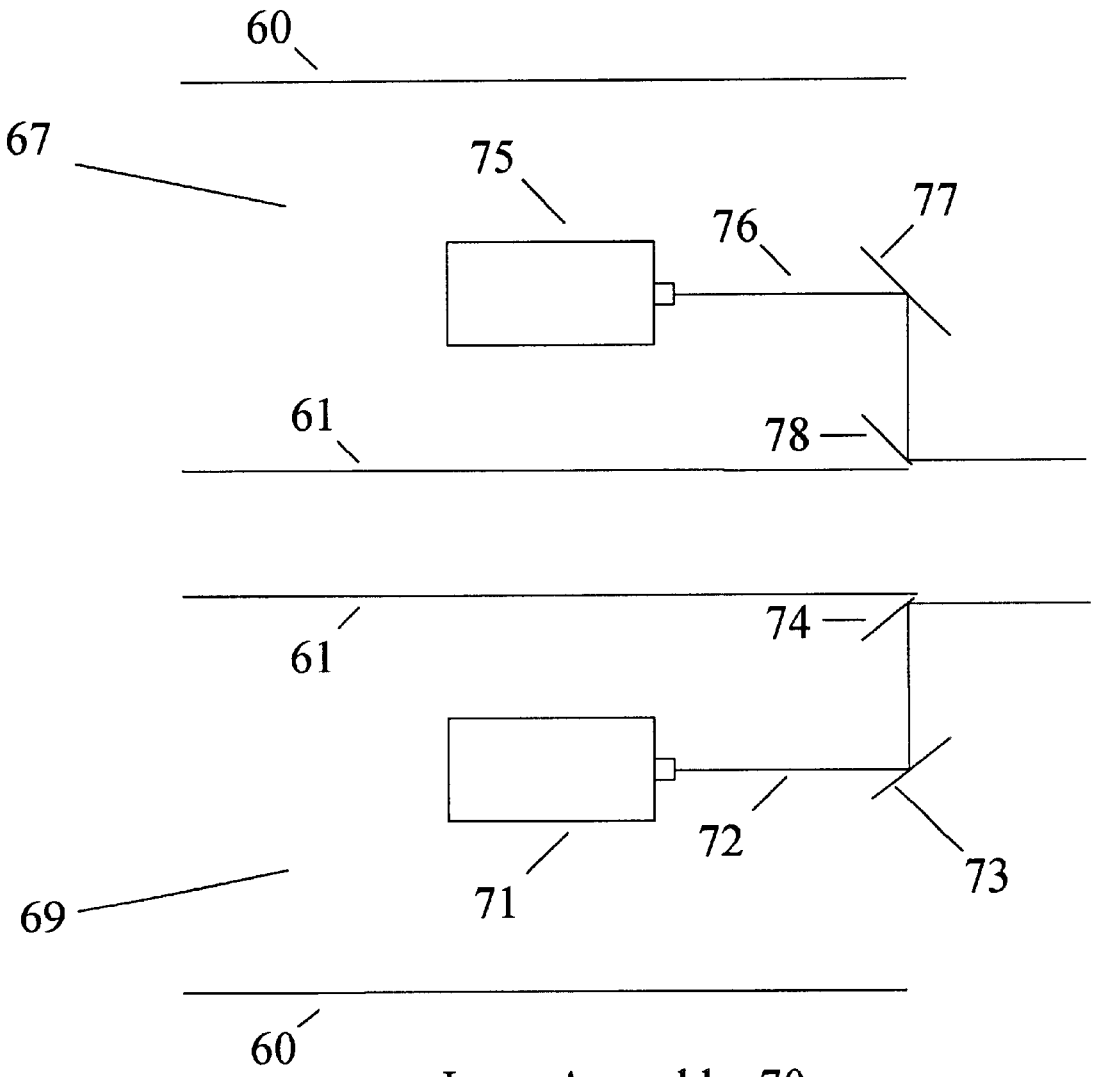
FIG. 7 shows an assembly with a laser system mounted in each of two opposing cavities shown in FIG. 6A.

Referring to FIG. 7, two opposing cavities (Cavity 67 and Cavity 69) each contain a laser system with associated mirrors to produce Laser Assembly 70. Cavity 67 contains Laser System 75, Mirror 77, and Mirror 78. Laser System 75 produces Beam 76 which is reflected off Mirror 77 and Mirror 78. Cavity 69 contains Laser System 71, Mirror 73, and Mirror 74. Laser System 71 produces Beam 72 which is reflected off Mirror 73 and Mirror 74.

Figure 8:
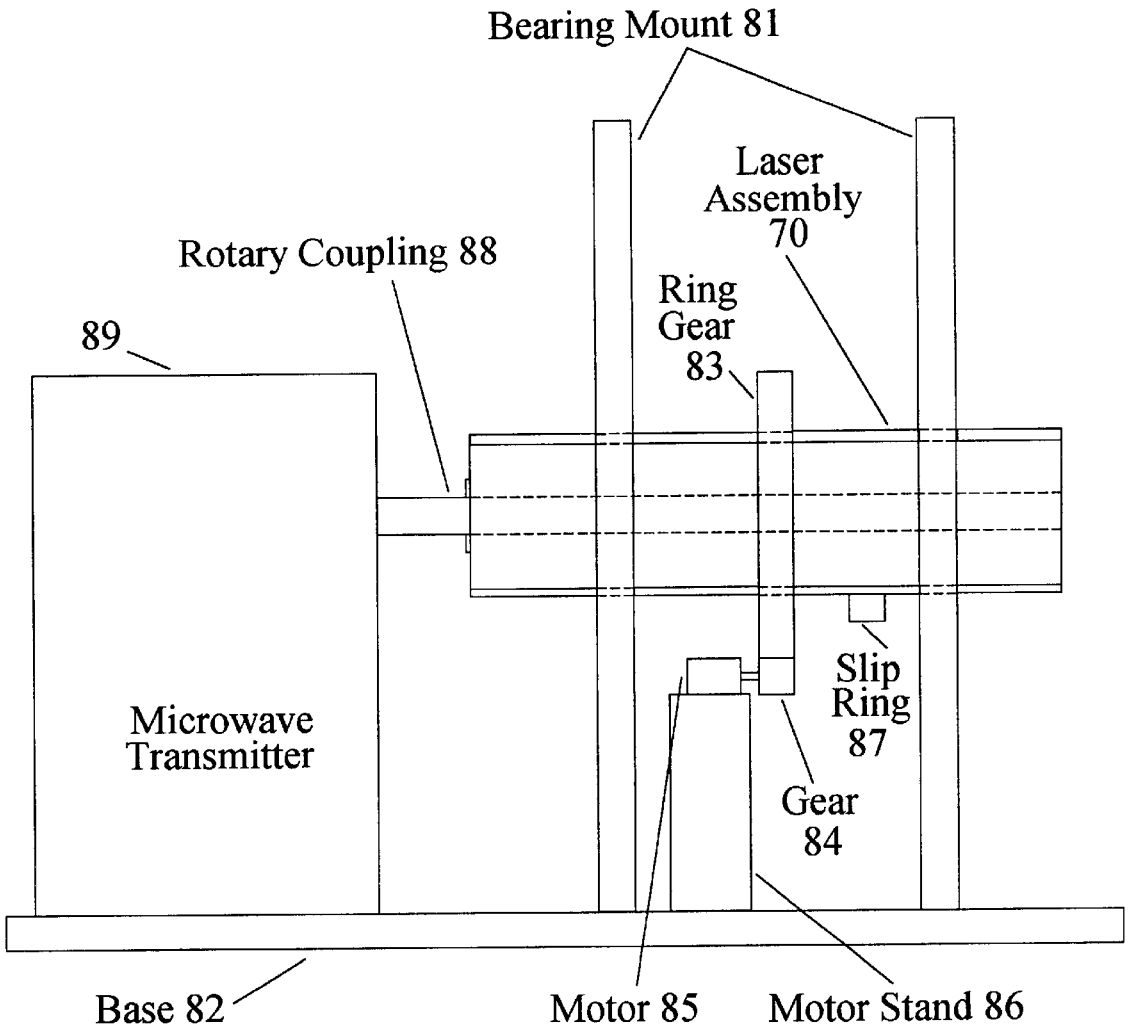
FIG. 8 shows the assembly of FIG. 7 supported by a bearing mount attached to a base, rotated by a motor, and coupled to a microwave transmitter.

In FIG. 8, Laser Assembly 70 is mounted on Bearing Mount 81 to allow Laser Assembly 70 to rotate. Ring Gear 83 is mounted around the circumference of Laser Assembly 70 and engages Gear 84 which is turned by Motor 85. Motor 85 is supported by Motor Stand 86. Base 82 supports both Motor Stand 86 and Bearing Mount 81. Microwave Transmitter 89 is also mounted on Base 82 and is coupled to Laser Assembly 70 through Rotary Coupling 88, whose design is well known to those in the field of Radar. Power to Laser Assembly 70 is supplied through Slip Ring Assembly 87. In operation, Laser Assembly 70 rotates, causing the beams from Laser System 75 and Laser System 71 to produce a cylindrical conducting shell to act as a waveguide for the energy from Microwave Transmitter 89. Mirrors 73, 74, 77, and 78 are precisely aligned so that only a single conductive shell is produced.

Referring to FIG. 7, the reason for using two laser systems is to dynamically balance Laser Assembly 70 and to reduce the speed at which the system must rotate. Alternately, one laser system can be replaced by the appropriate balancing weights. As a further alternative, more than two laser systems may be used as long as they are spaced appropriately in order to preserve the dynamic balance of Laser Assembly 70. Where more than one laser system is used, they are precisely aligned so that only a single conductive shell is produced.

Second Embodiment

The following describes a system using a single laser system where the laser system is stationary and the plasma beam conduit is formed by an opto-mechanical system using a parabolic section mirror with an offset feed. Microwave energy is coupled into the plasma beam conduit through a hole in the parabolic mirror section. The plasma beam conduit has a circular cross-section.

Figure 9A:
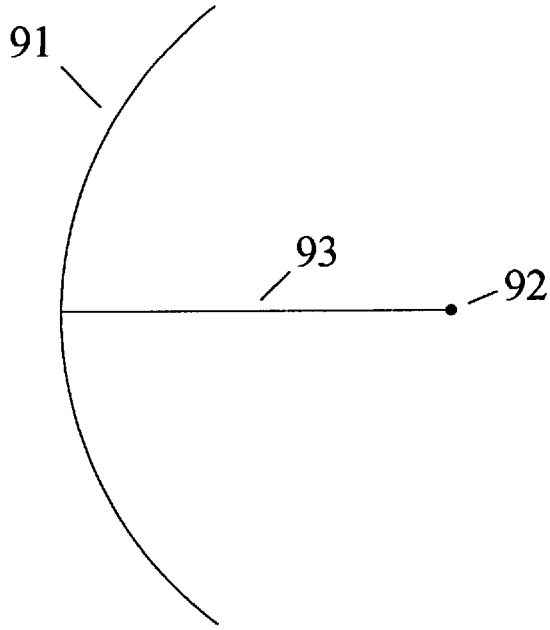
FIG. 9A shows the side view of a parabolic reflector with a center feedpoint.
Figure 9B:
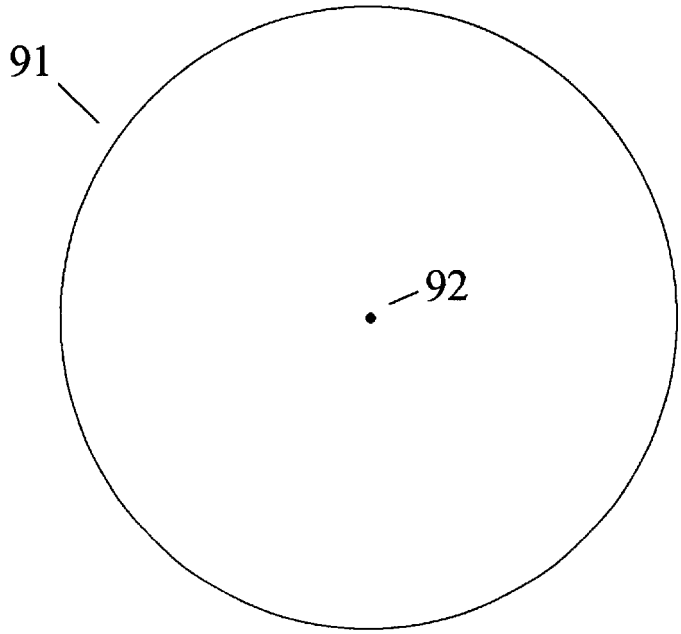
FIG. 9B shows the front view of a parabolic reflector shown in FIG. 9A.

FIG. 9A shows a side view of parabolic Reflector 91 with Axis 93 and Focal Point 92. FIG. 9B shows the front view of parabolic Reflector 91 and Focal Point 92.

A parabolic reflector has the property that all rays arriving parallel to the axis will be reflected to the focal point.

Figure 10A:
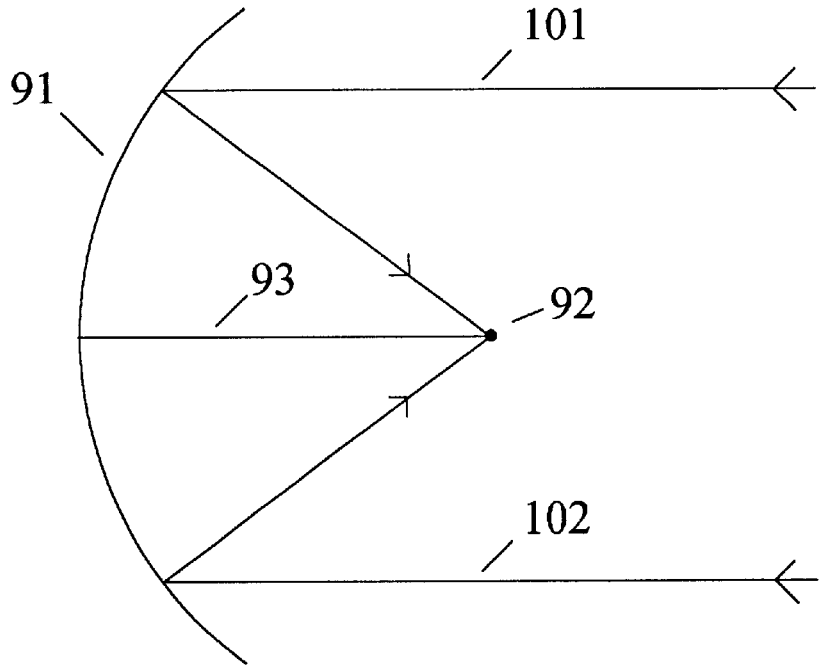
FIG. 10A shows the side view of a parabolic reflector with a center feedpoint where two incoming parallel rays are reflected to the feedpoint.

Referring to FIG. 10A, since Rays 101 and 102 are parallel to Axis 93 they are both reflected off Reflector 91 to Focal Point 92.

Similarly, all rays emanating from the focal point and reflecting off the parabolic reflector will depart parallel to the axis.

Figure 10B:
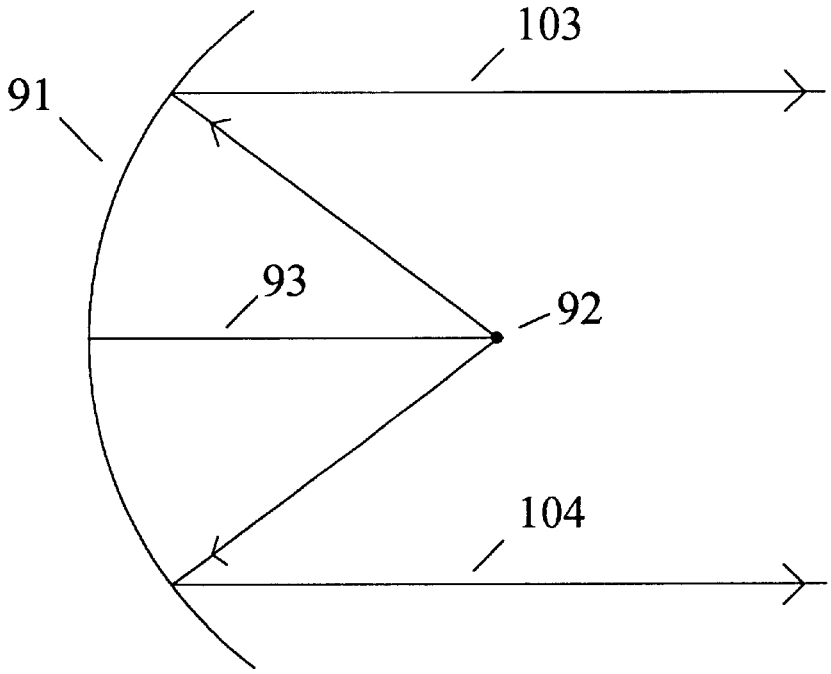
FIG. 10B shows the side view of a parabolic reflector with a center feedpoint where two rays coming from the feedpoint are reflected from the parabolic reflector as parallel rays.

Referring to FIG. 10B, since Rays 103 and 104 emanate from Focal Point 92 and reflect off Reflector 91, they will depart parallel to Axis 93.

Figure 11A:
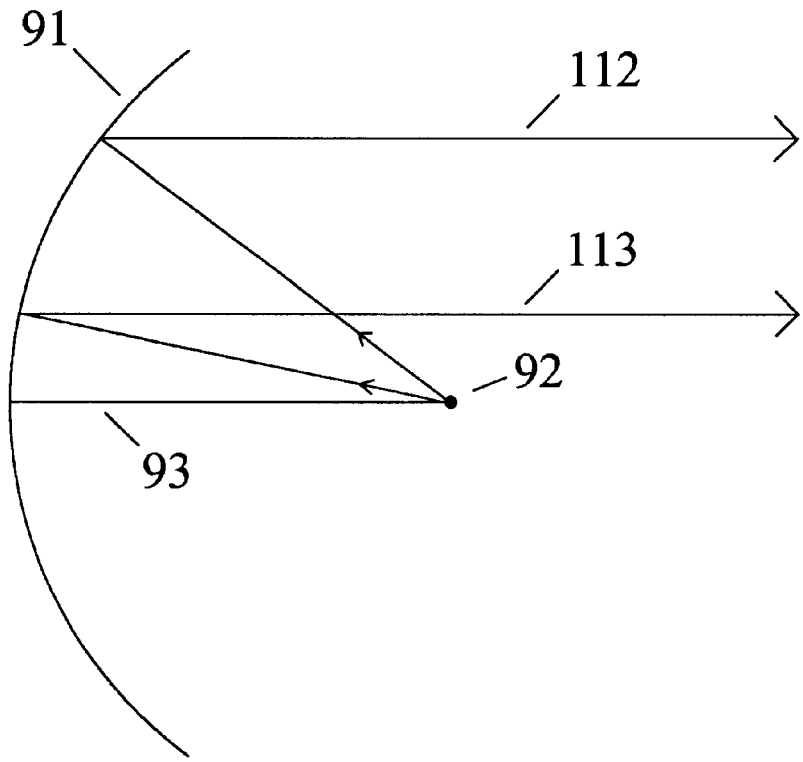
FIG. 11A shows the side view of a parabolic reflector with a center feedpoint where a different pair of rays coming from the feedpoint are reflected from the parabolic reflector as parallel rays.

Similarly, in FIG. 11A, Rays 112 and 113 emanate from Focal Point 92, reflect off Reflector 91, and depart parallel to Axis 93.

If we are only interested in Rays 112 and 113, we do not need all of Reflector 91.

Figure 11B:
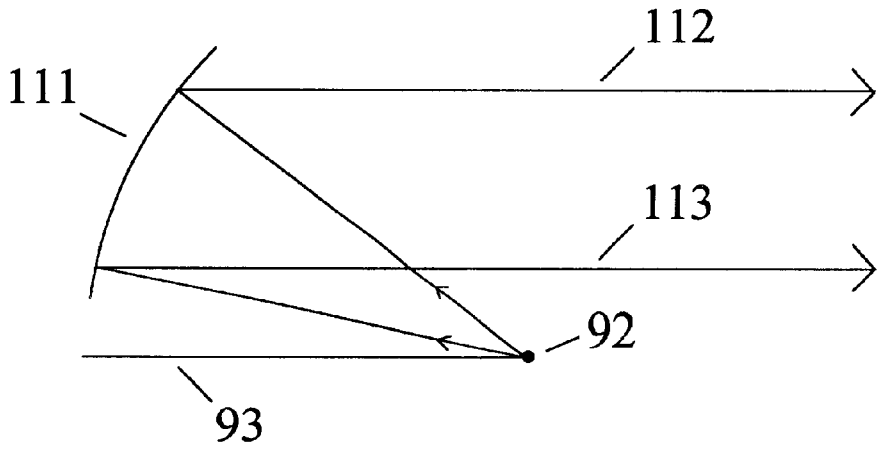
FIG. 11B shows the side view of the section of the parabolic reflector of FIG. 11A where the pair of rays coming from the feedpoint are reflected from the parabolic reflector as parallel rays.

FIG. 11B shows the only part of Reflector 91 that we do need, designated as Reflector 111. Note that Axis 93 still exists even though there is no physical reflector for it to intercept.

Figure 12A:
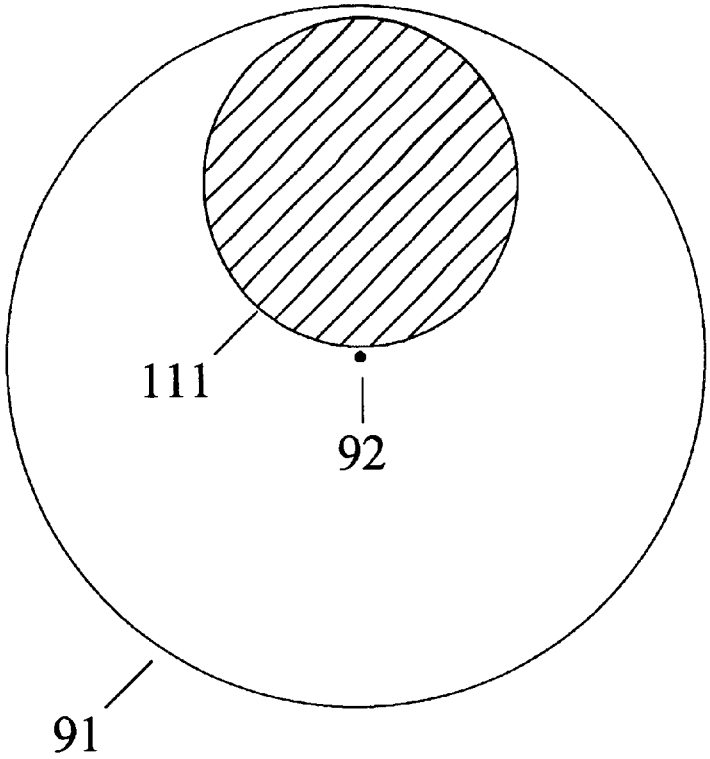
FIG. 12A shows the front view of the parabolic reflector of FIG. 11A where the area of the parabolic reflector used in FIG. 11B is highlighted.

FIG. 12A shows the front view of Reflector 111, which is the part of Reflector 91 needed to produce a cylinder where Rays 112 and 113 represent the boundaries of the cylinder. The part of Reflector 91 not used in Reflector 111 is simply not built. Note that Focal Point 92 is no longer in front of Reflector 111. This is known as an offset feedpoint.

Figure 12B:
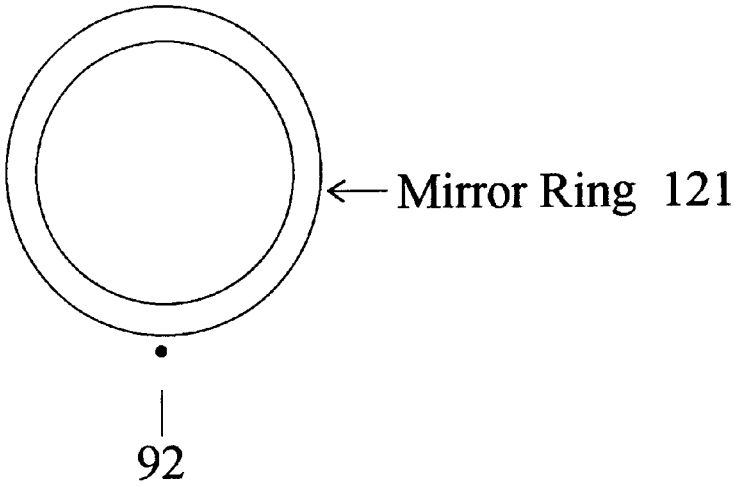
FIG. 12B shows the front view of the inside parabolic reflector of FIG. 12A where the center area of the inside parabolic reflector has been removed to form a mirror ring.
Figure 13A:
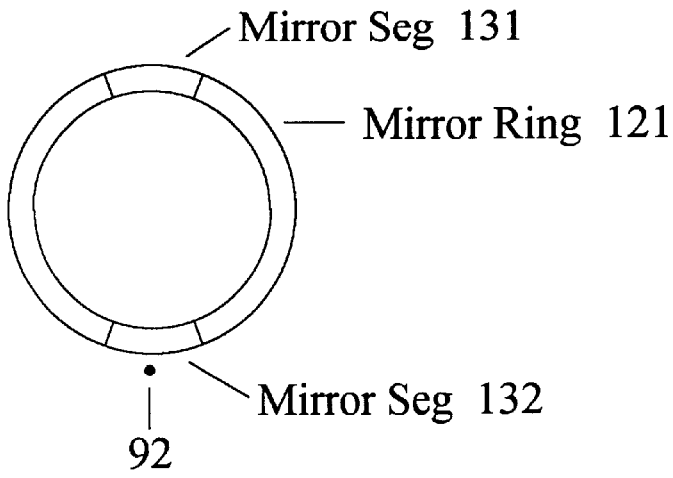
FIG. 13A shows the mirror ring of FIG. 12B with upper and lower segments marked.
Figure 13B:
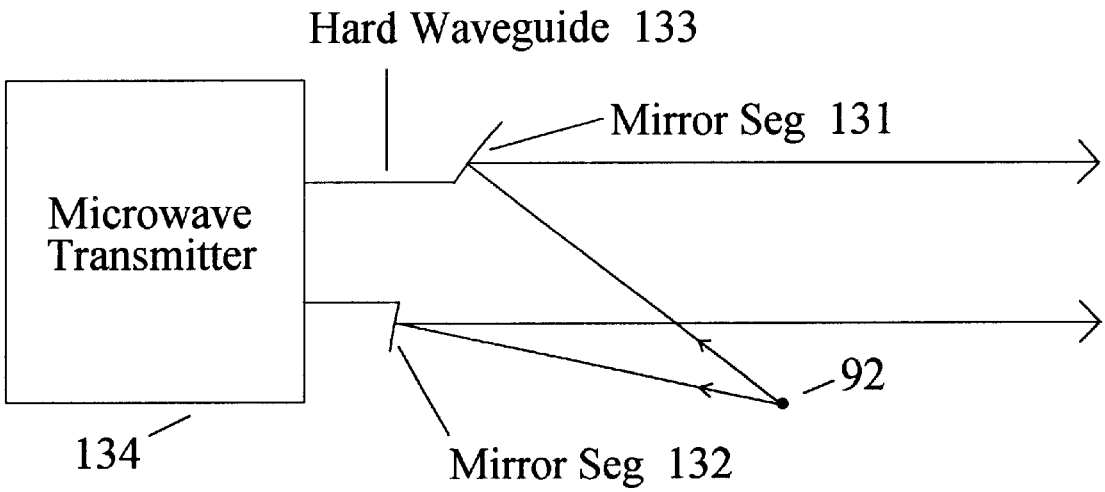
FIG. 13B shows the side view of the mirror ring of FIG. 13A with a hard waveguide attached to the center hole area and with rays coming from the offset feedpoint and reflecting off the upper and lower segments of the parabolic mirror ring.

Moving a light source from Focal Point 92 around the outside circumference of Reflector 111 produces a cylinder of light. Since we will only be using the outside of Reflector 111 we can make a hole in the center to produce Mirror Ring 121 as shown in FIG. 12B. The front view of Mirror Ring 111 is shown in FIG. 12B. In order to make the following drawings clearer we will designate Mirror Segment 131 and Mirror Segment 132 on Mirror Ring 121 in FIG. 13A. On drawings where Mirror Segment 131 and Mirror Segment 132 are shown it is to be understood that they are present as part of Mirror Ring 121. Referring to FIG. 13B, the side view of Mirror Ring 121 showing Mirror Segment 131 and Mirror Segment 132 shows two rays coming from Focal Point 92. A hole in the center of Mirror Ring 121 allows us to couple microwave energy from Microwave Transmitter 134 through microwave Hard Waveguide 133 to the center of Mirror Ring 121.

Figure 14:
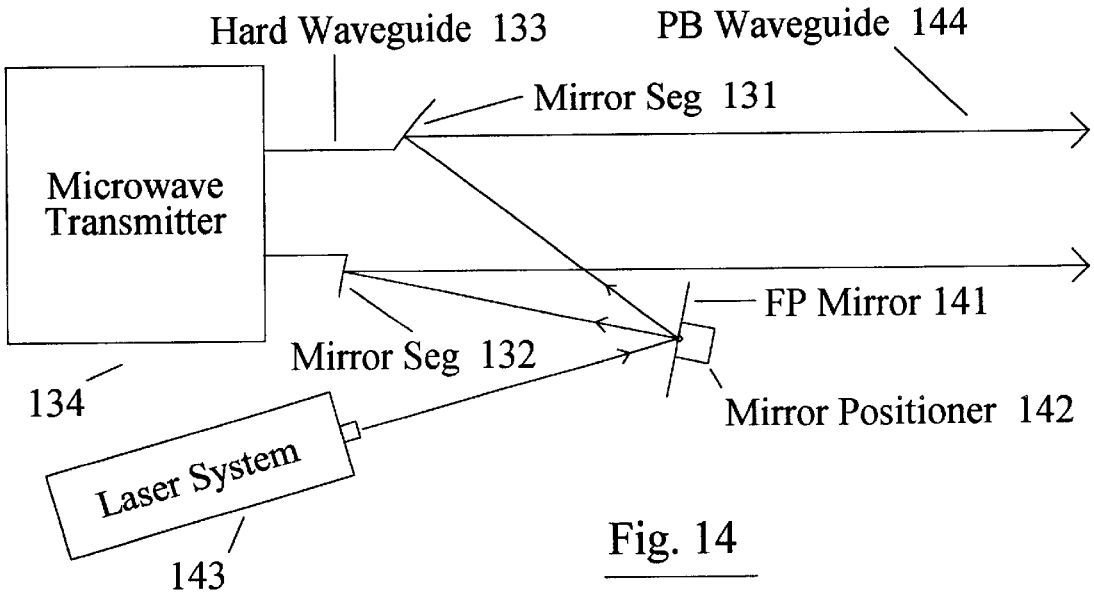
FIG. 14 shows the side view of the system of FIG. 13B where a two-axis mirror at the feedpoint directs the beam from a laser in a circular fashion around the periphery of the parabolic mirror ring.

In FIG. 14, for clarity only Mirror Segment 131 and Mirror Segment 132 of Mirror Ring 121 are shown. A flat mirror at the Focal Point, shown as FP Mirror 141, is mounted with two degrees of freedom and Mirror Positioner 142 directs the output from Laser System 143 around Mirror Ring 121 to produce a Plasma Beam Waveguide (PB Waveguide 144). Mirror Positioner 142 is of conventional electromechanical design.

Figure 15:
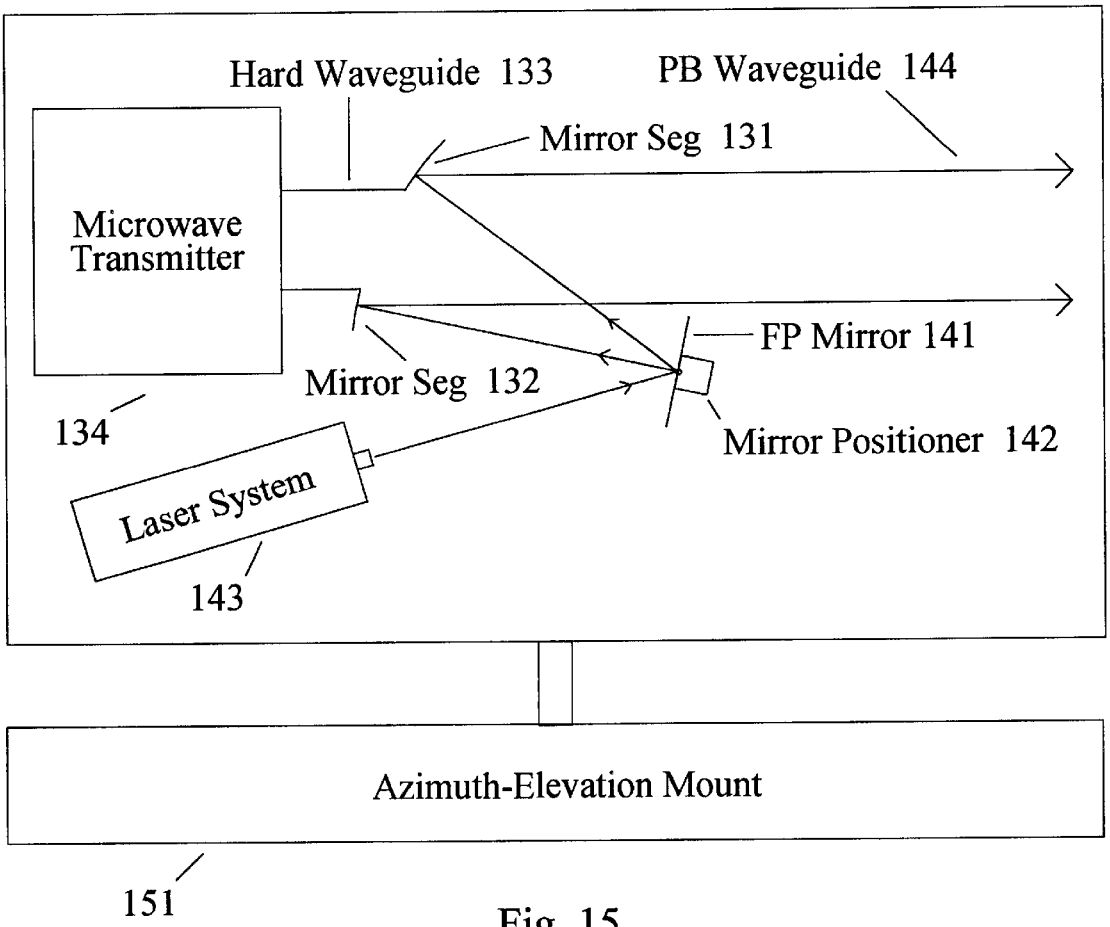
FIG. 15 shows the system of FIG. 14 mounted in an azimuth-elevation mount.

As shown in FIG. 15, the system can be aimed by mounting it in Azimuth-Elevation Mount 151, which is of conventional design.

Figure 16:
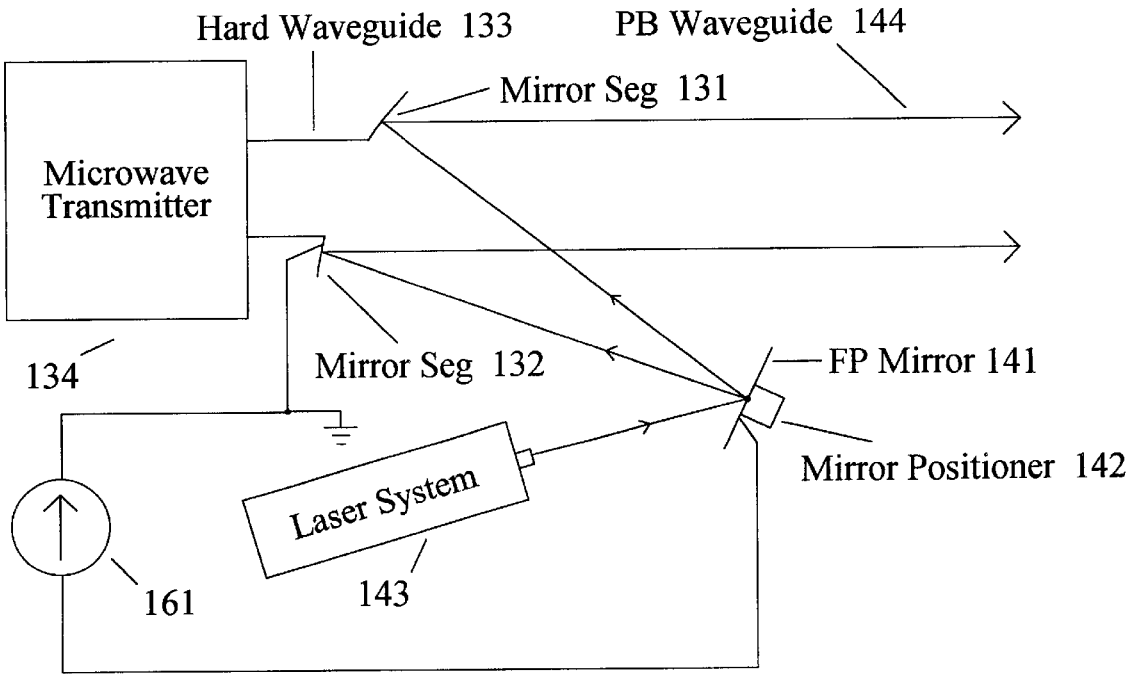
FIG. 16 shows how the Plasma Beam can be electrically accelerated between the feedpoint mirror and the parabolic mirror.

FIG. 16 shows how the Plasma Beam can be electrically accelerated between FP Mirror 141 and Mirror Ring 121 of which only Mirror Segment 131 and Mirror Segment 132 are shown. By using an electrically conducting material such as beryllium metal for FP Mirror 141 and Mirror Ring 121, and by using Current Source 161 to induce an electrical current between the two mirrors, the plasma beam produced by Laser System 143 is electrically accelerated. Normally, for operator safety, Current Source 161 will be grounded at Mirror Ring 121. Current Source 161 may be a direct current or an alternating current, and may also be modulated.

As one example, the transmission of 3 GHz. microwave energy requires a plasma beam waveguide with a diameter of approximately 2.5 inches. Naturally, other dimensions may be used in other applications with other requirements.

The following describes an opto-mechanical system using two laser systems where the laser systems are stationary and the plasma beam waveguide is formed by an opto-mechanical system using two parabolic section mirrors, each with an offset feed. The plasma beam conduit has a circular cross-section. This is the preferred embodiment.

Figure 17A:
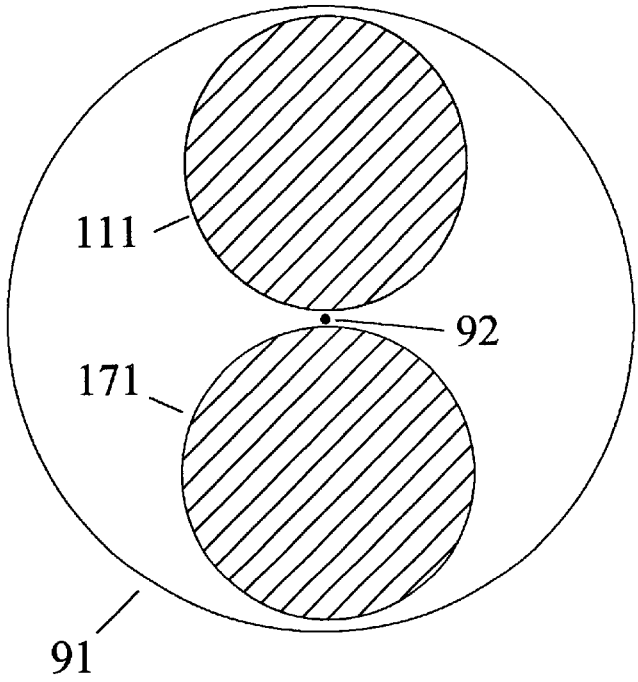
FIG. 17A shows the front view of a parabolic reflector where two areas of the parabolic reflector being used are highlighted.

FIG. 17A shows the front view of Parabolic Reflector 91 with Focal Point 92, where two inside areas of Parabolic Reflector 91 are highlighted. Area 111 has already been described in conection with FIG. 11B. Area 171 is a reflection of Area 111 and has the same properties.

Figure 17B:
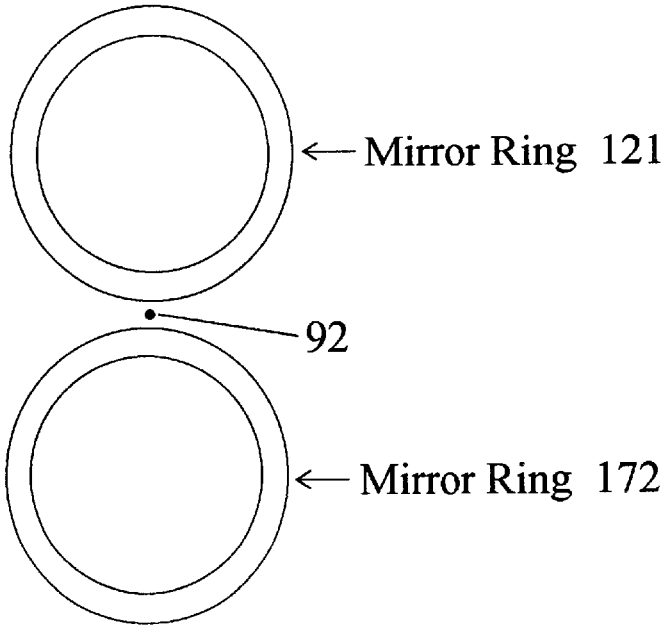
FIG. 17B shows the front view of the two inside areas of FIG. 17A where the center areas of the two inside areas have been removed to form two mirror rings.

FIG. 17B shows the front view of Area 111 and Area 171 of FIG. 17A where the center areas of Area 111 and Area 171 have been removed to form Mirror Ring 121 and Mirror Ring 172.

Figure 18A:
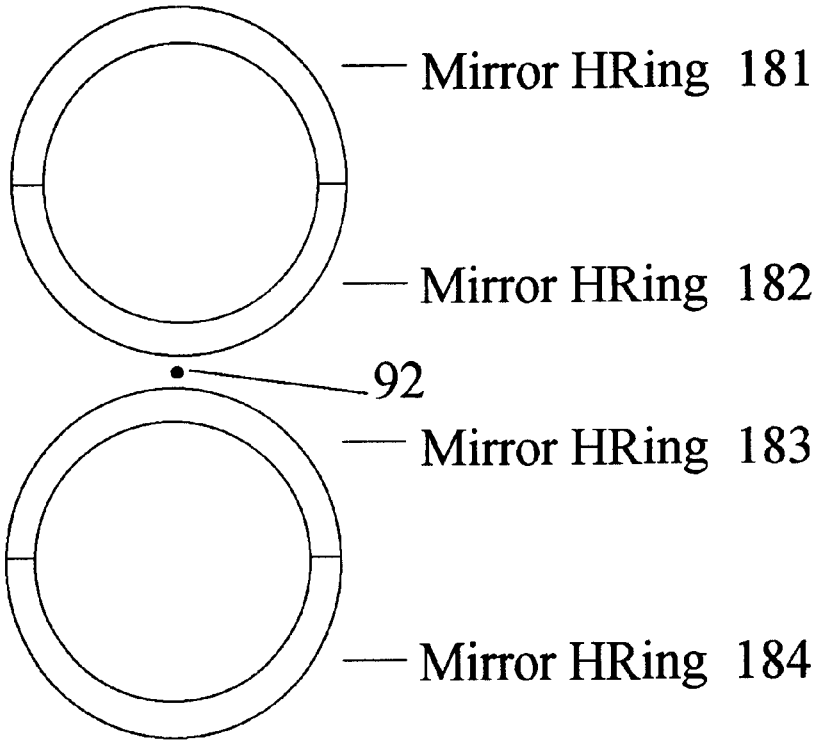
FIG. 18A shows the two mirror rings of FIG. 18B where each mirror ring is divided into upper and lower halves.

In FIG. 18A Mirror Ring 121 has been divided in half to form Mirror HRing 181 and Mirror HRing 182. Similarly, Mirror Ring 172 has been divided in half to form Mirror HRing 183 and Mirror HRing 184.

Figure 18B:
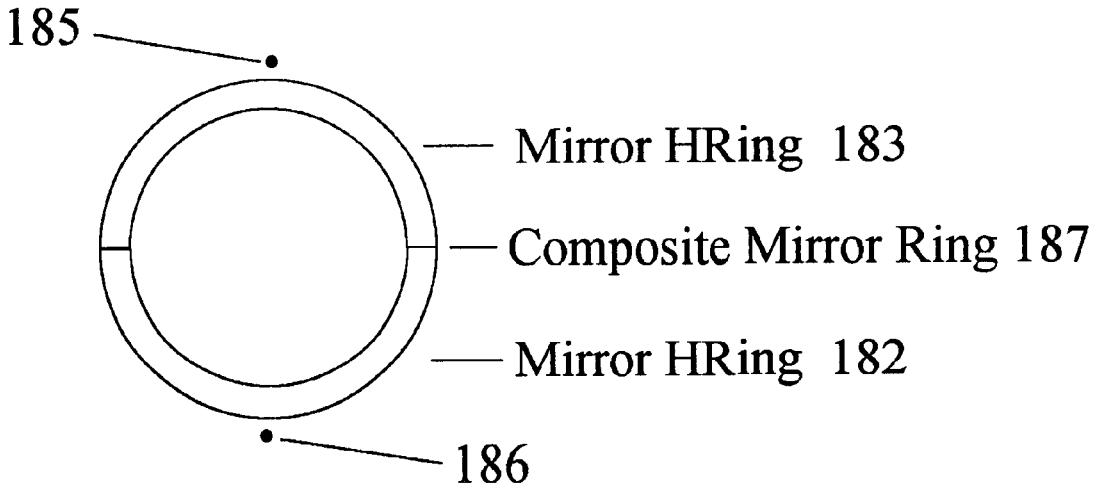
FIG. 18B shows a mirror ring formed from the upper half of the lower mirror ring of FIG. 18A and the lower half of the upper mirror ring of FIG. 18A.

In FIG. 18B Composite Mirror Ring 187 has been formed from the upper half of the lower mirror ring of FIG. 18A (Mirror HRing 183) and the lower half of the upper mirror ring of FIG. 18A (Mirror HRing 182). In order to distinguish the two focal points derived from Focal Point 92, the focal point associated with Mirror HRing 182 will be designated as Focal Point 186, while the focal point associated with Mirror HRing 183 will be designated as Focal Point 185.

Figure 19A:
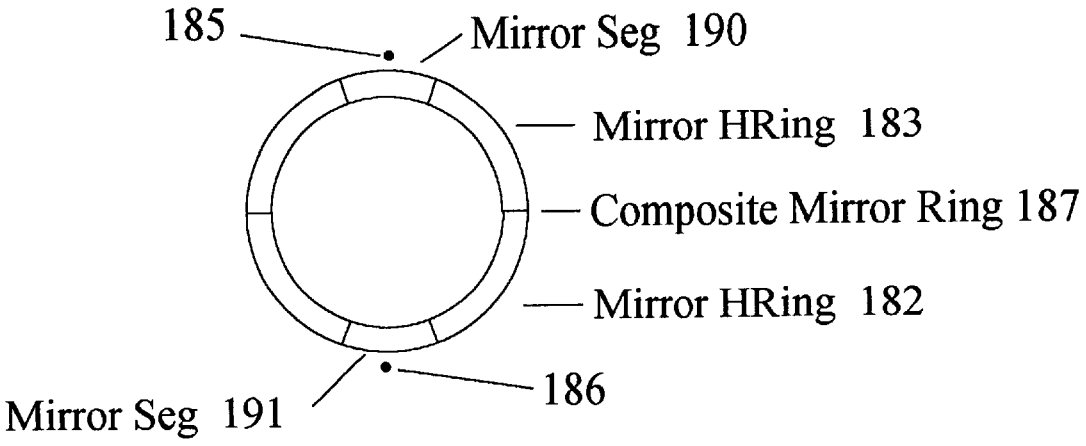
FIG. 19A shows the mirror ring of FIG. 18B with upper and lower segments marked.
Figure 19B:
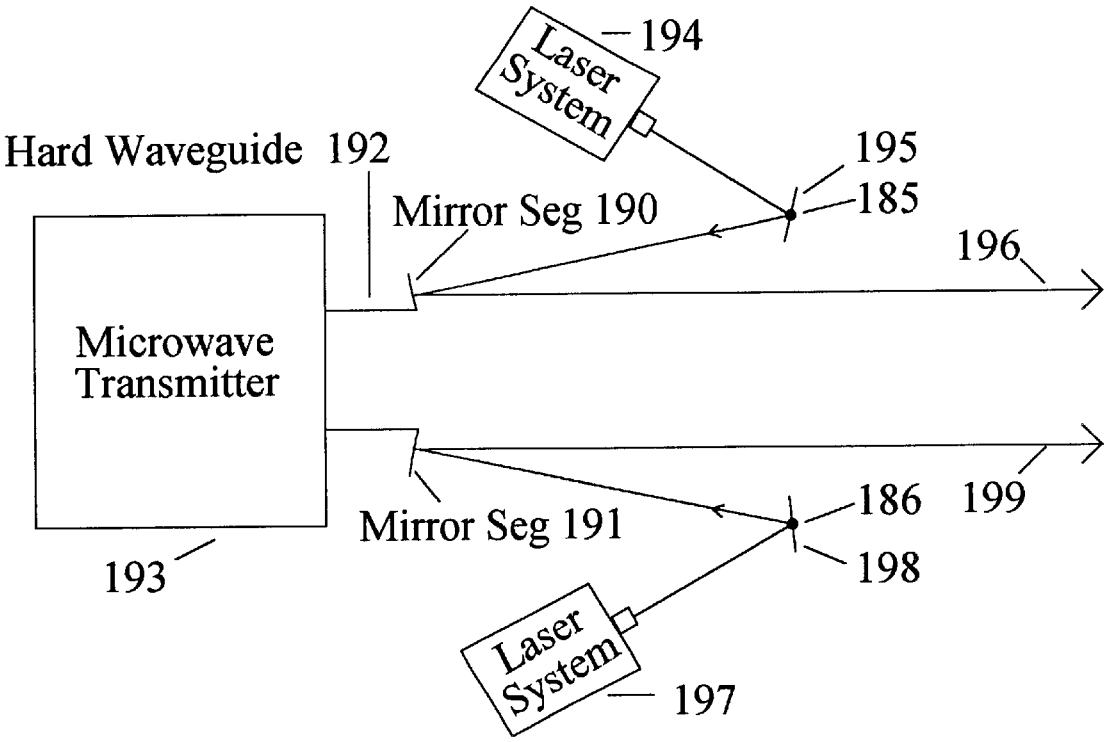
FIG. 19B shows the side view of a system using the mirror ring of FIG. 19A where a two-axis mirror at each feedpoint directs the beam from its associated laser system around its associated periphery of the parabolic mirror ring.

In order to make the following drawings clearer we will designate Mirror Segment 190 and Mirror Segment 191 on Composite Mirror Ring 187 as shown in FIG. 19A. In drawings where Mirror Segment 190 and Mirror Segment 191 are shown it is to be understood that they are present as part of Composite Mirror Ring 187 made of Mirror HRing 183 and Mirror HRing 182. Referring to FIG. 19B, the side view of Composite Mirror Ring 187 shows Ray 196 from Laser System 194 reflecting off Two-Axis Mirror Positioner 195 located at Focal Point 185 and Ray 199 from Laser System 197 reflecting off Two-Axis Mirror Positioner 198 located at Focal Point 186. With a full composite mirror Laser System 194, Mirror Positioner 195, and Mirror HRing 183 will produce the top half of the plasma beam waveguide, while Laser System 197, Mirror Positioner 198, and Mirror HRing 182 will produce the bottom half of the plasma beam waveguide. Hard Waveguide 192 couples the energy from Microwave Transmitter 193 to the center of Composite Mirror Ring 187.

Plasma beam waveguides of other cross-sectional shapes, such as rectangular, may be formed by appropriate mirror design.

The following describes a system using four laser systems where the laser systems are stationary and the plasma beam conduit is formed by an opto-mechanical system using four parabolic section mirrors, each with an offset feed. The plasma beam conduit has a rectangular cross-section.

Figure 20A:
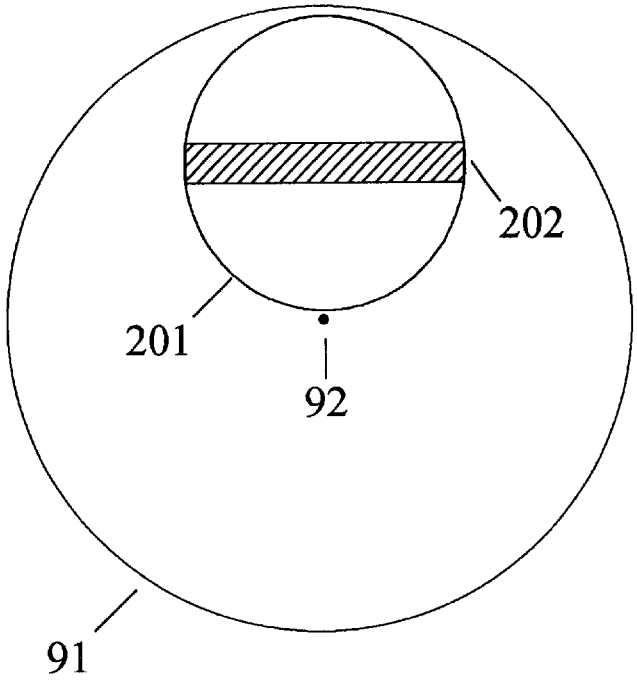
FIG. 20A shows the front view of a parabolic reflector where a rectangular segment of a parabolic reflector is highlighted.

FIG. 20A shows the front view of Parabolic Reflector 91 where Rectangular Segment 202 of Area 201 is highlighted. A ray emanating from Focal Point 92 that is directed along the center of the long axis of Rectangular Segment 202 will produce a planar beam.

Figure 20B:
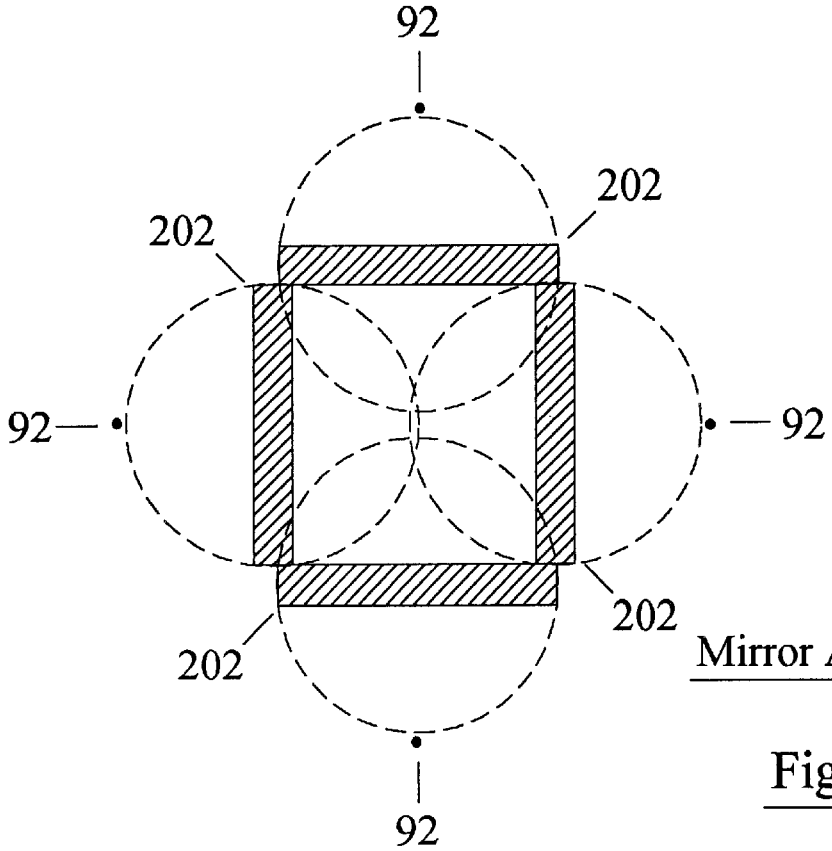
FIG. 20B shows a mirror assembly made from four indentical rectangular segments of FIG. 20A.

FIG. 20B shows Mirror Assembly 203 made from four indentical pieces, each one consisting of Rectangular Segment 202 in the appropriate position and orientation to form Mirror Assembly 203. Each rectangular segment has its own focal point.

Figure 21:
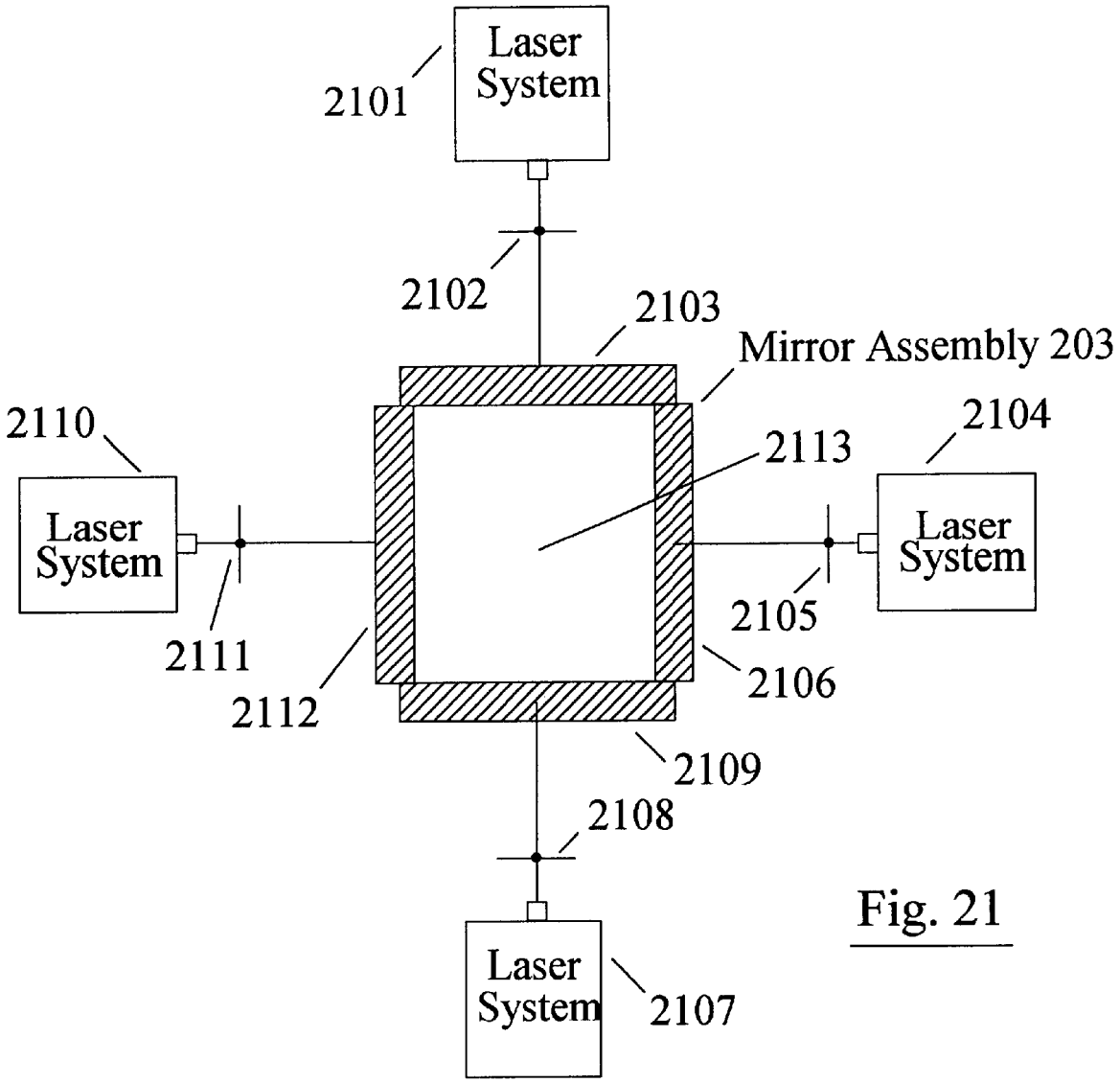
FIG. 21 shows each rectangular segment of FIG. 20B with its own associated feedpoint and laser system.

In FIG. 21 the top of the plasma beam waveguide is produced by Laser System 2101, Single-Axis Mirror Positioner 2102, and Rectangular Segment 2103. The right side of the plasma beam waveguide is produced by Laser System 2104, Single-Axis Mirror Positioner 2105, and Rectangular Segment 2106. The bottom of the plasma beam waveguide is produced by Laser System 2107, Single-Axis Mirror Positioner 2108, and Rectangular Segment 2109. The left side of the plasma beam waveguide is produced by Laser System 2110, Single-Axis Mirror Positioner 2111, and Rectangular Segment 2112. Square Section 2113 allows microwave energy to be coupled into the plasma beam waveguide.

Figure 22:
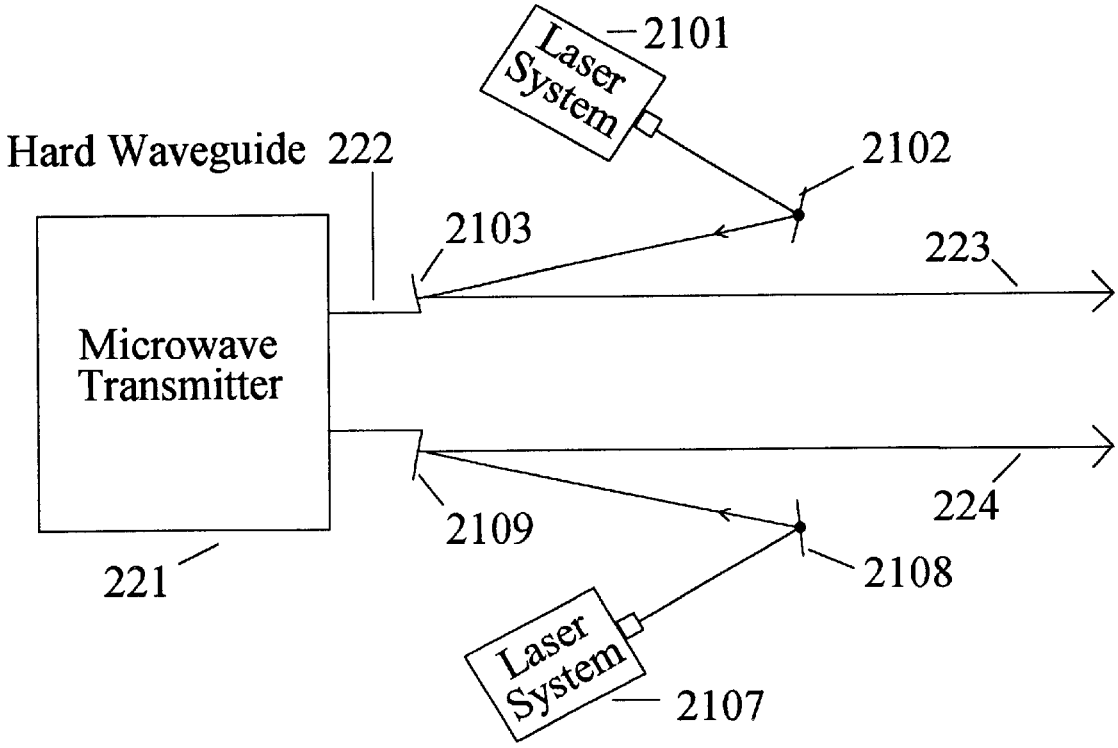
FIG. 22 shows the side view of a system using the rectangular mirror segments of FIG. 21 where a single-axis mirror at each feedpoint directs the beam from its associated laser system to its associated rectangular mirror segment. Only the upper and lower rectangular mirror segments are shown.

In FIG. 22, for clarity only the top and bottom parts are shown. The top of the plasma beam waveguide (223) is produced by Laser System 2101, Single-Axis Mirror Positioner 2102, and Rectangular Segment 2103. The bottom of the plasma beam waveguide (224) is produced by Laser System 2107, Single-Axis Mirror Positioner 2108, and Rectangular Segment 2109. The two sides not shown (Laser System 2104, Single-Axis Mirror Positioner 2105, Rectangular Segment 2106, Laser System 2110, Single-Axis Mirror Positioner 2111, and Rectangular Segment 2112 complete the plasma beam waveguide. Hard Waveguide 222 couples the energy from Microwave Transmitter 221 to the center of Mirror Assembly 203 and into the plasma beam waveguide.

Third Embodiment

The following describes a system using a single laser system where the laser system is stationary and the plasma beam conduit is formed by an opto-electromagnetic system using a parabolic section mirror with an offset feed. Microwave energy is coupled into the plasma beam conduit through a hole in the parabolic mirror section. The plasma beam conduit has a circular cross-section.

Figure 23:
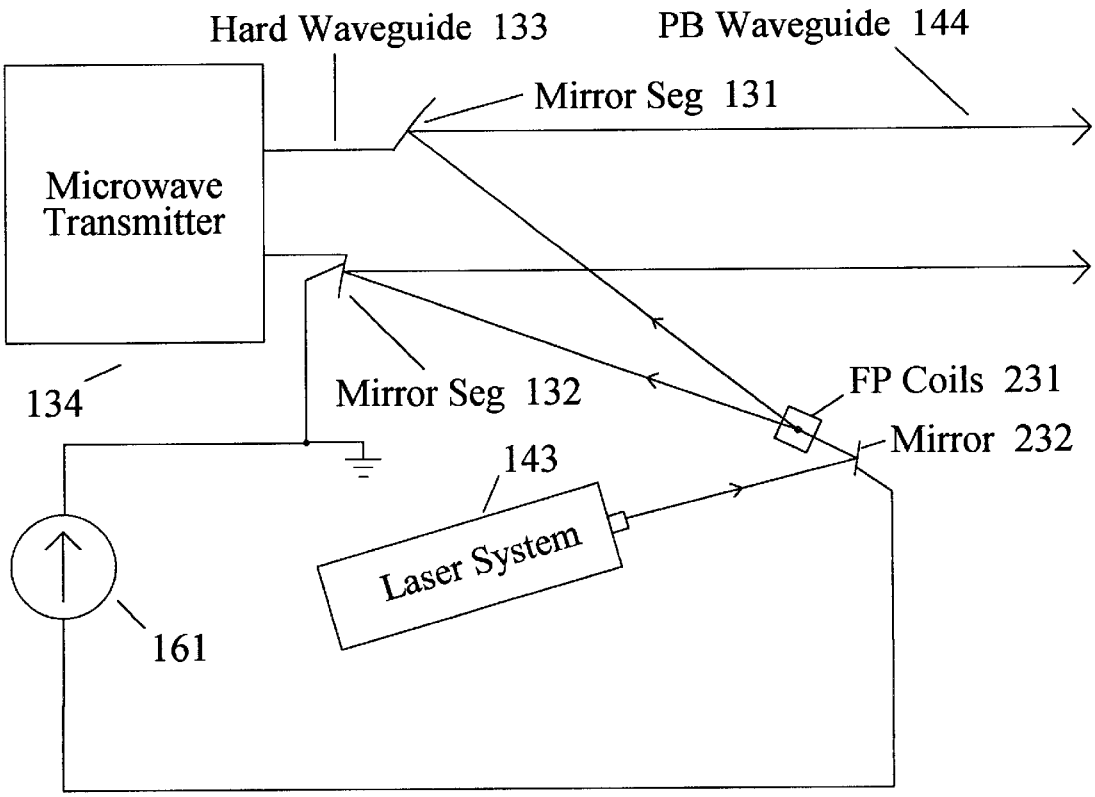
FIG. 23 shows the side view of a system where the plasma beam is electrically accelerated and then magnetically deflected in a circular fashion around the periphery of the parabolic mirror ring by a pair of electromagnetic coils located at the feedpoint.

FIG. 23 shows Mirror Segment 131, Mirror Segment 132, Hard Waveguide 133, Microwave Transmitter 134, and Laser System 143 as previously described in connection with FIG. 16. However, in this embodiment a pair or orthogonal electromagnetic coils (FP Coils 231) located at the feedpoint are used to deflect the plasma beam around the periphery of Mirror Ring 121, of which only Mirror Segment 131 and Mirror Segment 132 are shown. FP Coils 231 are electrically driven to produce a changing magnetic field to deflect the plasma beam in a circular fashion around the periphery of Mirror Ring 121. Mirror 232 is used for providing a conducting surface in order to provide an electrically path through the plasma beam. As with the Second Embodiment, more than one laser system may be used by choosing the appropriate configuration of parabolic section mirrors. The method taught in the Second Embodiment may also be used to produce a rectangular waveguide.

While preferred embodiments of the present invention have been shown, it is to be expressly understood that modifications and changes may be made thereto and that the present invention is set forth in the following claims.

I claim:

1. An apparatus for transmitting microwave energy through the atmosphere comprising:

(a) one or more laser systems, whereby each said one or more laser systems produces a thin ionizing beam through the atmosphere;

(b) a mechanical means for rotating said one or more laser systems such that said thin ionizing beam from said one or more laser systems produces a single conductive shell;

(c) a microwave transmitter;

(d) a means for coupling the output of said microwave transmitter to said conductive shell;

whereby said single conductive shell acts as a waveguide for said output of said microwave transmitter.

2. The apparatus of claim 1 further including an electrical current means for accelerating said thin ionizing beam from said one or more laser systems.

3. An apparatus for transmitting microwave energy through the atmosphere comprising:

(a) one or more laser systems, whereby each said one or more laser systems produces a thin ionizing beam through the atmosphere;

(b) an opto-mechanical means for moving said thin ionizing beam from said one or more laser systems to produce a single conductive shell, whereby said opto-mechanical means comprises one or more parabolic section mirrors and a controllable flat mirror at the focal point of each said one or more parabolic section mirrors;

(c) a microwave transmitter;

(d) a means for coupling the output of said microwave transmitter to said conductive shell;

whereby said single conductive shell acts as a waveguide for said output of said microwave transmitter.

4. The apparatus of claim 3 further including an electrical current means for accelerating said thin ionizing beam from said one or more laser systems.

5. An apparatus for transmitting microwave energy through the atmosphere comprising:

(a) one or more laser systems, whereby each said one or more laser systems produces a thin ionizing beam through the atmosphere;

(b) an opto-electromagnetic means for moving said thin ionizing beam from said one or more laser systems to produce a single conductive shell, whereby said opto-electromagnetic means comprises:

(i) an electrical current means for accelerating said thin ionizing beam from said one or more laser systems;

(ii) a pair of electrically driven orthogonal magnetic coils for deflecting said thin ionizing beam from said one or more laser systems;

(iii) one or more parabolic section mirrors;

(c) a microwave transmitter;

(d) a means for coupling the output of said microwave transmitter to said conductive shell;

whereby said single conductive shell acts as a waveguide for said output of said microwave transmitter.

6. A method for transmitting microwave energy through the atmosphere comprising the steps of:

(a) using one or more laser systems to produce a thin ionizing beam through the atmosphere;

(b) mechanically rotating said one or more laser systems such that said thin ionizing beam from said one or more laser systems produces a single conductive shell;

(c) coupling the output of a microwave transmitter to said single conductive shell;

whereby said single conductive shell acts as a waveguide for said output of said microwave transmitter.

7. The method of claim 6 further including the step of electrically accelerating said thin ionizing beam from said one or more laser systems.

8. A method for transmitting microwave energy through the atmosphere comprising the steps of:

(a) using one or more laser systems to produce a thin ionizing beam through the atmosphere;

(b) using opto-mechanical means to move said thin ionizing beam from said one or more laser systems to produce a single conductive shell, whereby said opto-mechanical means moves said thin ionizing beam from said one or more laser systems to produce a single conductive shell by using one or more parabolic section mirrors and a controllable flat mirror at the focal point of each said one or more parabolic section mirrors;

(c) coupling the output of a microwave transmitter to said single conductive shell;

whereby said single conductive shell acts as a waveguide for said output of said microwave transmitter.

9. The method of claim 8 further including the step of electrically accelerating said thin ionizing beam from said one or more laser systems.

10. A method for transmitting microwave energy through the atmosphere comprising the steps of:

(a) using one or more laser systems to produce a thin ionizing beam through the atmosphere;

(b) using opto-electromagnetic means for moving said thin ionizing beam from said one or more laser systems to produce a single conductive shell, whereby said opto-electromagnetic means comprises the steps of:

(i) using an electrical current means for accelerating said thin ionizing beam from said one or more laser systems;

(ii) using a pair of electrically driven orthogonal magnetic coils for deflecting said thin ionizing beam from said one or more laser systems;

(iii) using one or more parabolic section mirrors; (c) coupling the output of a microwave transmitter to said single conductive shell;

whereby said single conductive shell acts as a waveguide for said output of said microwave transmitter.

11. A method for transmitting microwave energy through the atmosphere comprising the steps of:

(a) using one or more laser systems to produce a thin ionizing beam through the atmosphere;

(b) using said thin ionizing beam from said one or more laser systems to produce a single conductive shell;

(c) coupling the output of a microwave transmitter to said single conductive shell;

whereby said single conductive shell acts as a waveguide for said output of said microwave transmitter.

* * * * *